US008455421B2

(12) United States Patent
Seddon et al.

(10) Patent No.: US 8,455,421 B2
(45) Date of Patent: Jun. 4, 2013

(54) COMPOSITIONS AND METHODS FOR THE REMOVAL OF CHEWING GUM RESIDUES FROM SUBSTRATES

(75) Inventors: Kenneth R. Seddon, Belfast Antrim (GB); Nimal Gunaratne, Belfast Antrim (GB); Martyn J. Earle, Belfast Antrim (GB); Manuela Gilea, Belfast Antrim (GB); Gill Stephens, Belfast Antrim (GB); Ekaterina Ivanova, Manchester (GB); Lars Rehmann, London (CA); Edward Green, Bucks (GB)

(73) Assignee: Expelliere Int Ltd, Belfast Antrim (GB)

( * ) Notice: Subject to any disclaimer, the term of this patent is extended or adjusted under 35 U.S.C. 154(b) by 112 days.

(21) Appl. No.: 13/061,013

(22) PCT Filed: Aug. 28, 2009

(86) PCT No.: PCT/GB2009/051097

§ 371 (c)(1),
(2), (4) Date: Aug. 16, 2011

(87) PCT Pub. No.: WO2010/023490

PCT Pub. Date: Mar. 4, 2010

(65) Prior Publication Data

US 2011/0319309 A1 Dec. 29, 2011

(30) Foreign Application Priority Data

Sep. 1, 2008 (GB) ..... 0815874.3
Jul. 21, 2009 (GB) ..... 0912643.4

(51) Int. Cl.
*C11D 7/50* (2006.01)
*C11D 1/62* (2006.01)

(52) U.S. Cl.
CPC ..... *C11D 1/62* (2013.01)
USPC ..... 510/200; 134/40

(58) Field of Classification Search
CPC ..... C11D 1/62
USPC ..... 510/200; 134/40
See application file for complete search history.

(56) References Cited

U.S. PATENT DOCUMENTS

| | | | | |
|---|---|---|---|---|
| 6,080,391 | A | 6/2000 | Tsuchiya et al. | |
| 7,737,102 | B2 * | 6/2010 | Hecht et al. | 510/237 |
| 7,776,810 | B2 * | 8/2010 | Jordan et al. | 510/329 |
| 7,786,064 | B1 * | 8/2010 | Hecht et al. | 510/237 |
| 7,786,065 | B2 * | 8/2010 | Hecht et al. | 510/303 |
| 8,044,120 | B2 * | 10/2011 | D'Andola et al. | 524/35 |
| 8,088,917 | B2 * | 1/2012 | Forsyth et al. | 540/484 |
| 2006/0090271 | A1 * | 5/2006 | Price et al. | 8/490 |
| 2006/0090777 | A1 * | 5/2006 | Hecht et al. | 134/42 |
| 2006/0094615 | A1 * | 5/2006 | Hecht et al. | 510/179 |
| 2006/0094617 | A1 * | 5/2006 | Price et al. | 510/189 |
| 2006/0094620 | A1 * | 5/2006 | Jordan et al. | 510/286 |
| 2006/0189499 | A1 * | 8/2006 | Hecht et al. | 510/320 |
| 2006/0211096 | A1 | 9/2006 | Kragl et al. | |
| 2008/0017224 | A1 | 1/2008 | Price et al. | |
| 2008/0138465 | A1 | 6/2008 | Soper et al. | |
| 2008/0296531 | A1 * | 12/2008 | Whiston et al. | 252/182.3 |
| 2009/0233829 | A1 * | 9/2009 | Hecht et al. | 510/222 |
| 2009/0270248 | A1 * | 10/2009 | Earl et al. | 502/167 |
| 2010/0048829 | A1 * | 2/2010 | D'Andola et al. | 525/418 |
| 2010/0209991 | A1 * | 8/2010 | Hecht et al. | 435/183 |
| 2011/0144079 | A1 * | 6/2011 | Earle et al. | 514/187 |
| 2012/0010334 | A1 * | 1/2012 | D'Andola et al. | 524/35 |
| 2012/0090430 | A1 * | 4/2012 | Rogers et al. | 75/300 |
| 2012/0190844 | A1 * | 7/2012 | Forsyth et al. | 540/543 |

FOREIGN PATENT DOCUMENTS

| | | | |
|---|---|---|---|
| EP | 1495680 | A1 | 1/2005 |
| EP | 1826266 | A1 | 8/2007 |
| GB | 2 336 596 | A | 10/1999 |
| GB | 2430675 | A | 4/2007 |
| JP | 10262566 | A | 10/1998 |
| WO | WO-01/90289 | A1 | 11/2001 |
| WO | WO-02/076230 | A1 | 10/2002 |
| WO | WO-2004/003120 | A2 | 1/2004 |
| WO | WO-2006/050312 | A2 | 5/2006 |
| WO | WO-2006/099866 | A1 | 9/2006 |
| WO | WO-2007/089316 | A2 | 8/2007 |

OTHER PUBLICATIONS

International Preliminary Report on Patentability for Application No. PCT/GB2009/051097, dated Mar. 1, 2011.
International Search Report and Written Opinion for Application No. PCT/GB2009/051097, dated Oct. 23, 2009.
Abe et al., Design of phosphonium ionic liquids for lipase-catalyzed transesterification, J. Mol. Catalysis B: Enzymatic, abstract only (2008).
Enoki et al., Oxidative degradation of cis- and trans-1,4-polybutadienes by horseradish peroxidase/1-hydroxybenzotriazole, Polymer Degradation and Stability, 84:321-6 (2004).
Enoki et al., Oxidative degradation of trans-1,4-polyisoprene cast films and single crystals by enzyme-mediator systems, Macromol. Biosci., 3:668-74 (2003).
Fujisawa et al., Degradation of polyethylene and nylon-66 by the laccase-mediator system, J. Polymers Environment, 9:103-8 (2001).
Gumbusters work to find solution, BBC News, 1 page (Aug. 14, 2006).
Hinckley et al., Oxidative enzymes possess catalytic activity in systems with ionic liquids, Biotechnol. Lett., 24:2083-7 (2002).
Madeira et al., Dissolution of Candida antarctica lipase B in ionic liquids: effects on structure and activity, R. Soc. Chem., abstract only (2004).
McKie (ed.), Scientists target £150m chewing gum menace with organic salt solution, The Observer, 2 pp. (May 4, 2008).

(Continued)

*Primary Examiner* — Gregory Webb
(74) *Attorney, Agent, or Firm* — Marshall, Gerstein & Borun LLP

(57) ABSTRACT

This invention relates to methods for removing chewing gum and residues thereof from substrates using chewing gum modifying compositions comprising ionic liquids. In one embodiment, the chewing gum modifying composition may be used together with one or more oxidising reagents. In another embodiment, the chewing gum removal compositions further comprise one or more enzymes and one or more enzyme mediator compounds. The invention further relates to novel ionic liquid and enzyme compositions that are suitable for use in removing chewing gum residues.

25 Claims, No Drawings

OTHER PUBLICATIONS

Morozova et al., Laccase-mediator systems and their applications: A review, Appl. Biochem. Microbiol., 43:523-35 (2007).

Nakamiya et al., Enzymatic degradation of polystyrene by hydroquinone peroxidase of *Azotobacter beijerinckii* HM121, J. Fermentation Bioengineer., 84:480-2 (1997).

Sato et al., Degradation of vulcanized and nonvulcanized polyisoprene rubbers by lipid peroxidation catalyzed by oxidative enzymes and transition metals, Biomacromolecules, 4:321-9 (2003).

Shipovskov et al., Catalytic activity of laccases in aqueous solutions of ionic liquids, Green Chemistry, 7 pp. (2008).

Takamoto et al., Lipase-catalyzed hydrolytic degradation of polyurethane in organic solvent, Chem. Lett., pp. 492-493 (2001).

Tavares et al., Ionic liquids as alternative co-solvents for lacasse: study of enzyme activity and stability, Biotechnol. Bioengineer., 7 pp. (2008).

* cited by examiner

COMPOSITIONS AND METHODS FOR THE REMOVAL OF CHEWING GUM RESIDUES FROM SUBSTRATES

The present invention relates to methods for removing chewing gum and residues thereof from substrates using chewing gum modifying compositions comprising ionic liquids. In a further embodiment, the chewing gum modifying composition may be used together with one or more oxidising reagents. In another embodiment, the chewing gum removal compositions further comprise one or more enzymes and one or more enzyme mediator compounds. The invention further relates to novel ionic liquid and enzyme compositions that are suitable for such use.

It is well known that chewing gum residues have a tendency to stick firmly to substrates with which they come into contact. Chewing gum residues on pavements are unsightly and, as the gum residue is substantially non-biodegradable, the residues tend to accumulate over time.

Conventional chewing gum compositions are a complex mixture of ingredients which comprise a water-soluble portion, which typically comprises sweeteners, flavourings, food colourings and fillers, and a water-insoluble portion, referred to as "gum base", which typically comprises elastomers (which provide the chewy, cohesive texture of the gum), plasticizers, softeners and waxes, together with auxiliaries such as emulsifiers and antioxidants. The gum base provides the textural and masticatory properties of chewing gum. It is the insoluble gum base which remains after the gum has been chewed, and thus it is this part of the gum which is responsible for the occurrence of unsightly deposits on pavements.

The amount of the various ingredients in a chewing gum composition depends on the type of gum. For instance, bubble gums generally contain lower amounts of gum base, e.g. 15 to 20% by weight, whereas normal chewing gums typically contain 25 to 33% by weight of gum base, although they may contain as much as 60% by weight of gum base.

All types of chewing gum, including bubble gum, are considered to be within the scope of the present invention. For instance, the present invention is considered to include chewing gums containing between 10 and 75% by weight of gum base.

Historically, gum base has been derived from natural gums such as chicle. Chicle is a gum derived from the sap of the *Sapodilla* tree, and is a natural polysaccharide elastomer of xylose in a (1→4)β-D-xylopyranose conformation substituted with D-glucoronic acid and L-arabinose. Other natural gums that are, or have been, used in chewing gums include jelutong, sorva, gutta percha, gutta hang kang, niger gutta, gutta kataiu, chilte, chiquibul, massaranduba balata, massaranduba chocolate, nispero, leche, caspi and rosidinha.

The use of natural gums in chewing gum has diminished in recent years, due to scarcity and inconsistency of the crops, and the development of synthetic elastomers which give the chewing gum improved flavour and texture. Examples of synthetic elastomers used in chewing gum compositions are polyisoprene (1), polybutadiene (2), styrene-butadiene copolymers (3), polyisobutylene (4), polyvinylacetate (5), polyethylene (6), as well as isobutylene-isoprene copolymer, vinyl acetate-vinyl laurate copolymer, crosslinked polyvinyl pyrrolidone, polymethylmethacrylate, copolymers of lactic acid, polyhydroxyalkanoates, plasticized ethylcellulose, polyvinyl acetatephthalate and combinations thereof.

1

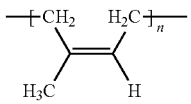

2

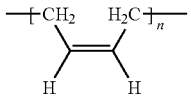

3

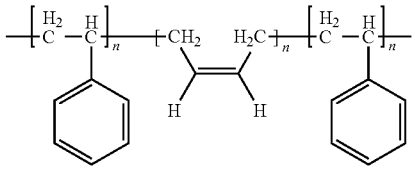

4

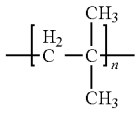

5

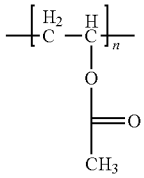

6

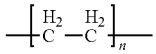

The amount of elastomer used in the gum base depends on a variety of factors, including the type, or types, of elastomer used, the desired consistency of the gum, and the other components of the gum base. A typical gum base composition comprises between 5 and 80% elastomer by weight, more commonly between 10 and 60% by weight, and most commonly between 20 and 40% by weight. A notable feature of many of these elastomers is a saturated hydrocarbon backbone that is difficult to break down, and therefore such compounds are generally considered non-biodegradable.

The gum base also includes plasticizers and softeners, which are used to soften the elastomer component. Many plasticizers are suitable for use in gum bases, including terpene resins such as polymers of alpha-pinene or beta-pinene, methyl, glycerol and pentaerythritol esters of rosins, and modified rosins such as hydrogenated, dimerized and polymerized rosins, and mixtures thereof. Specific examples of plasticizers include the pentaerythritol esters of partially hydrogenated wood and gum rosins, the pentaerythritol esters of wood and gum rosins, the glycerol esters of wood rosin, the glycerol esters of partially dimerized wood and gum rosins, the glycerol esters of polymerized wood and gum rosins, the glycerol ester of tall oil rosin, the glycerol esters of wood and gum rosins and partially hydrogenated wood and gum rosins, the methyl esters of partially hydrogenated wood and gum rosins, and mixtures thereof. Other plasticizers that may be found in gum include glycerol triacetate and polyvinyl alcohol. Typically, plasticizers constitute around 50% by weight of the gum base composition. The softeners used in gum bases are usually derived from natural fats and oils, and include tallow, cocoa butter, sunflower oil and palm oil. Artificial softeners include various synthetic glycerol esters and triglycerides, such as triacetin. The softener may comprise up to around 20% by weight of the gum base composition.

In addition, the gum base may include waxes such as paraffin waxes to improve the elasticity of the gum base and to soften the elastomeric mixture. Typical waxes used in chewing gum have a melting point between 45 and 60° C. and are present in the gum base in an amount of up to 10% by weight, more preferably between 5 and 10% by weight. In some cases, the gum base may also include higher melting waxes, such as petroleum wax or beeswax, which are typically present in the gum base in amounts of up to 5% by weight.

When chewing gum residues are discarded onto pavements, it is the elastomers, resins and wax components of the gum base that are responsible for the adhesive effect of the residues. The waxes promote wetting of the substrate by the soft plastic mass of gum remaining after chewing. As substrate wetting occurs, the gum residue spreads over the substrate and the elastomer and resin components of the gum base are then able to interact mechanically with the microporous structure of materials such as paving stones. When chewing gum residues are dropped on a pavement substrate, e.g. sandstone, it is thought that the polymeric chains of the elastomer and the resin components of the gum base effectively become entangled in the cage-like structure of the sandstone, forming a strong mechanical link which is the physical basis of the adhesion of gum residues to pavements.

Current methods for removing chewing gum from pavements are generally time consuming and costly, and usually need to be carried out by specialist companies. Most methods of removing gum residues work by disrupting the non-covalent interactions between the gum and the substrate using high pressure water or steam, although chemical additives are sometimes added to soften, dissolve or dissipate the gum. However, these techniques are costly due to the large amounts of energy required to generate high pressure water or steam; they are abrasive and may therefore cause damage to the grouting between paving slabs and to soft substrates such as tarmac; and they cause inconvenience to the public. For such reasons, the use of high pressure water or steam cleaning systems is generally confined to periodic programs for "deep cleaning" street surfaces, usually taking place at night, and is inappropriate for day-to-day cleaning operations. In addition, such techniques are often inappropriate for use in confined areas, interior surfaces, and areas where the use of large quantities of water, steam or chemicals may be restricted.

An alternative approach is to dissolve the gum using organic solvents. However, most organic solvents that could be used for this purpose are poisonous, flammable or harmful to the environment and are therefore hazardous to operators and unsuitable for use in public places. Chewing gum is hydrophobic and therefore incompatible with aqueous removal compositions.

Another technique that is sometimes used to remove chewing gum residues involves applying a cryogenic substance, such as dry ice or liquid nitrogen, to the residue. This promotes an elastic-to-glass transition of the polymer in the gum residue. The glass is an ordered, rigid and brittle structure with the polymer chains in an aligned crystalline state. The brittle gum residue can then be fragmented by mechanical means and then swept or vacuumed from the substrate. Obvious disadvantages of such methods are the cost of cryogenic substances, the potential risk to operators using such substances, intensive labour requirements, and inconvenience to the public.

Another approach to the removal of chewing gum residues has been to use chemical processes to disrupt the covalent structure of the gum base in the residue. However, this approach has also been largely unsuccessful. The chemical nature of chewing gum residues, which mainly comprise chemically inert hydrocarbon polymers, requires vigorous chemistry that is either not feasible, or is unsafe to use in the absence of suitable containment conditions. For these reasons, there are not believed to be any conventional, commercially exploited methods for removing chewing gum residues that involve covalent modification of the gum components.

One approach to the problem of chewing gum deposits has been to develop chewing gums with increased biodegradability or decreased stickiness. However, there has been little progress in this area, mainly because the commercially important features of chewing gum, such as texture, flavour retention and shelf life, tend to be impaired when the chemical structure of the gum base is changed.

Accordingly, there is a clear need for alternative methods for dealing with contamination by chewing gum residues. Desirable characteristics of any new method for removing chewing gum residues include: reduced cost; reduced need for specialist equipment and specially trained operators; reduced energy and water requirements; reduced labour requirements; reduced risk to operators, the public and the environment; and reduced inconvenience to the public. Accordingly, any composition to be used in such a method will desirably be: non-toxic; non-flammable; environmentally friendly; fast acting; effective at low temperatures; easy to use without special training; easy to rinse away with low pressure water leaving no residues that require further cleaning; suitable for use with existing cleaning equipment.

It has now been unexpectedly discovered that compositions comprising ionic liquids can be used in the removal of chewing gum residues from substrates. The compositions and methods of the present invention have one or more of the desirable characteristics outlined above, and therefore overcome many of the disadvantages of current methods for the removal of chewing gum residues.

Ionic liquids are a novel class of compounds which have been developed over the last few years. The term "ionic liquid" as used herein refers to a liquid that is capable of being produced by melting a salt, and when so produced consists solely of ions. An ionic liquid may be formed from a homogeneous substance comprising one species of cation and one species of anion, or it can be composed of more than one species of cation and/or more than one species of anion. Thus, an ionic liquid may be composed of more than one species of cation and one species of anion. An ionic liquid may further be composed of one species of cation, and one or more species of anion. Still further, an ionic liquid may be composed of more than one species of cation and more than one species of anion.

The term "ionic liquid" includes compounds having both high melting points and compounds having low melting points, e.g. at or below room temperature (i.e. 0 to 25° C.). The latter are often referred to as "room temperature ionic liquids" and often derived from organic salts having pyridinium and imidazolium based cations. In room temperature ionic liquids, the structures of the cation and anion prevent the formation of an ordered crystalline structure and therefore the salt is liquid at room temperature.

Ionic liquids are most widely known as solvents, because their negligible vapour pressure, temperature stability, low flammability and recyclability make them environmentally friendly. Due to the vast number of anion/cation combinations that are available it is possible to fine tune the physical properties of the ionic liquid (e.g. melting point, density, viscosity, and miscibility with water or organic solvents) to suit the requirements of a particular application.

Two approaches to the removal of chewing gum residues from substrates are envisaged. A first approach is to make the chewing gum residues more fluid, i.e. by disrupting the molecular structure of the residue such that it becomes more mobile. The increased fluidity makes it easier to remove the chewing gum residue from the substrate (possibly with the aid of a mechanical step, such as hosing with low pressure water at ambient temperature).

A second approach is to make the polymer molecules in the chewing gum residue self-associate so as to increase the rigidity and brittleness of the residue. The residue will then detach from a substrate when a physical force is applied, often with fragmentation of the residue. Ideally, the force required should be as low as possible. As described above, this has previously been achieved by decreasing the temperature so as to increase the non-covalent interactions between the components of the chewing gum residue.

In a first aspect, the present invention provides a method of modifying a chewing gum residue so as to ease removal of the chewing gum residue from a substrate, the method comprising applying to the residue a chewing gum modifying composition comprising an ionic liquid. It has been found that the resulting residue has both reduced adhesiveness to the substrate and is also softer and more fluid, making it easier to remove. In preferred embodiments, the polymer-polymer interactions and polymer-substrate interactions are sufficiently disrupted to allow the residue to be simply washed away by low pressure hosing with water at ambient temperatures, or by rainfall.

The exact mechanisms by which the chewing gum removal composition facilitates the removal of chewing gum residues are not known. Without wishing to be bound by any particular mechanism of action, however, it is thought that the ionic liquid penetrates the polymer matrix of the chewing gum residue, disrupting non-covalent interactions between the components of the residue (referred to herein as polymer-polymer interactions) and between the residue and the substrate to which it is attached (referred to herein as polymer-substrate interactions). However, it is not ruled out that the ionic liquid may also cause some degree of covalent modification of the components of the elastomeric composition.

Ionic liquids suitable for use in the present invention may be defined by the formula:

$$[Cat]^+[X]^-;$$

wherein: $[Cat]^+$ is a cationic species; and $[X]^-$ is an anionic species.

In accordance with the present invention, $[Cat]^+$ may be a cationic species selected from ammonium, azaannulenium, azathiazolium, benzofuranium, borolium, diazabicyclodecenium, diazabicyclononenium, diazabicycloundecenium, dithiazolium, furanium, imidazolium, indolinium, indolium, morpholinium, oxaborolium, oxaphospholium, oxazinium, oxazolium, iso-oxazolium, oxathiazolium, pentazolium, phospholium, phosphonium, phthalazinium, piperazinium, piperidinium, pyranium, pyrazinium, pyrazolium, pyridazinium, pyridinium, pyrimidinium, pyrrolidinium, pyrrolium, quinazolinium, quinolinium, iso-quinolinium, quinoxalinium, selenazolium, tetrazolium, iso-thiadiazolium, thiazinium, thiazolium, thiophenium, triazadecenium, triazolium, or iso-triazolium.

In one embodiment, $[Cat]^+$ is a cationic species selected from:

$$[N(R^a)(R^b)(R^c)(R^d)]^+ \text{ and } [P(R^a)(R^b)(R^c)(R^d)]^+$$

wherein $R^a$, $R^b$, $R^c$, and $R^d$ are each independently selected from a $C_1$ to $C_{15}$ straight chain or branched alkyl group, a $C_3$ to $C_8$ cycloalkyl group, or a $C_6$ to $C_{10}$ aryl group, wherein said alkyl, cycloalkyl or aryl groups are unsubstituted or may be substituted by one to three groups selected from: $C_1$ to $C_6$ alkoxy, $C_2$ to $C_{12}$ alkoxyalkoxy, $C_6$ to $C_{10}$ aryl, $C_2$ to $C_{15}$ straight chain or branched alkenyl, —CN, —OH, —$NO_2$, —$CO_2$($C_1$ to $C_6$)alkyl, —OC(O)($C_1$ to $C_6$)alkyl, $C_7$ to $C_{30}$ aralkyl and $C_7$ to $C_{30}$ alkaryl, and wherein $R^b$ may also be hydrogen.

Preferably, $[Cat^+]$ is selected from:

$$[N(R^a)(R^b)(R^c)(R^d)]^+ \text{ and } [P(R^a)(R^b)(R^c)(R^d)]^+$$

wherein $R^a$, $R^b$, $R^c$, and $R^d$ are each independently selected from a $C_1$ to $C_{15}$ straight chain or branched alkyl group, a $C_3$ to $C_8$ cycloalkyl group, or a $C_6$ to $C_{10}$ aryl group, wherein said alkyl, cycloalkyl or aryl groups are unsubstituted or may be substituted by one to three groups selected from: $C_1$ to $C_6$ alkoxy, $C_2$ to $C_{12}$ alkoxyalkoxy, $C_6$ to $C_{10}$ aryl, —CN, —OH, —$NO_2$, —$CO_2$($C_1$ to $C_6$)alkyl, —OC(O)($C_1$ to $C_6$)alkyl, $C_7$ to $C_{30}$ aralkyl and $C_7$ to $C_{30}$ alkaryl, and wherein $R^b$ may also be hydrogen.

More preferably, $[Cat^+]$ is selected from:

$$[N(R^a)(R^b)(R^c)(R^d)]^+ \text{ and } [P(R^a)(R^b)(R^c)(R^d)]^+$$

wherein $R^a$, $R^b$, $R^c$, and $R^d$ are each independently selected from a $C_1$ to $C_{10}$ straight chain or branched alkyl group, a $C_3$ to $C_6$ cycloalkyl group, or a $C_6$ aryl group, wherein said alkyl, cycloalkyl or aryl groups are unsubstituted or may be substituted by one to three groups selected from: $C_1$ to $C_6$ alkoxy, $C_2$ to $C_{12}$ alkoxyalkoxy, $C_6$ to $C_{10}$ aryl, —CN, —OH, —$NO_2$, —$CO_2$($C_1$ to $C_6$)alkyl, —OC(O)($C_1$ to $C_6$)alkyl, $C_7$ to $C_{10}$ aralkyl and $C_7$ to $C_{10}$ alkaryl, and wherein $R^b$ may also be hydrogen.

Still more preferably, $[Cat]^+$ is selected from:

$$[N(R^a)(R^b)(R^c)(R^d)]^+$$

wherein $R^a$, $R^b$, $R^c$, and $R^d$ are each independently selected from a $C_1$ to $C_8$ straight chain or branched alkyl group, a $C_3$ to $C_6$ cycloalkyl group, or a $C_6$ aryl group, wherein said alkyl, cycloalkyl or aryl groups are unsubstituted or may be substituted by one to three groups selected from: $C_1$ to $C_6$ alkoxy, $C_2$ to $C_{12}$ alkoxyalkoxy, $C_6$ to $C_{10}$ aryl, —CN, —OH, —$NO_2$, —$CO_2$($C_1$ to $C_6$)alkyl, —OC(O)($C_1$ to $C_6$)alkyl, $C_7$ to $C_{10}$ aralkyl and $C_7$ to $C_{10}$ alkaryl, and wherein $R^b$ may also be hydrogen.

Further examples include wherein $R^a$, $R^b$, $R^c$ and $R^d$ are independently selected from methyl, ethyl, n-propyl, n-butyl, n-pentyl, n-hexyl, n-heptyl, n-octyl, n-nonyl and n-decyl, each of which is optionally substituted as described above. More preferably two or more, and most preferably three or more, of $R^a$, $R^b$, $R^c$ and $R^d$ are selected from methyl, ethyl, butyl and octyl.

In a further preferred embodiment, one of more of $R^a$, $R^b$, $R^c$ and $R^d$ may be independently substituted by a group selected from —OH, —CN, or —O(($C_1$ to $C_6$)alkylene)O(($C_1$ to $C_6$)alkyl). Most preferably one of more of $R^a$, $R^b$, $R^c$ and $R^d$ may be independently substituted by —OH.

Specific examples of preferred ammonium cations suitable for use according to the present invention include:

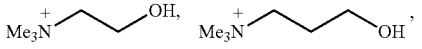

([$N_{1,1,1,2OH}$]) ([$N_{1,1,1,3OH}$])

-continued
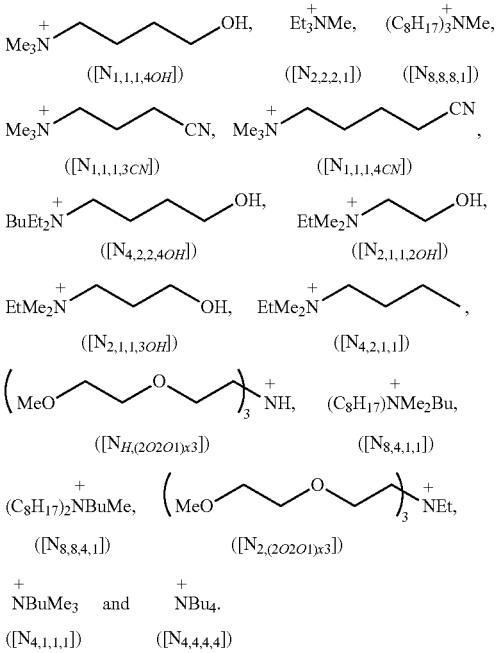
Still more preferred are ammonium cations selected from:
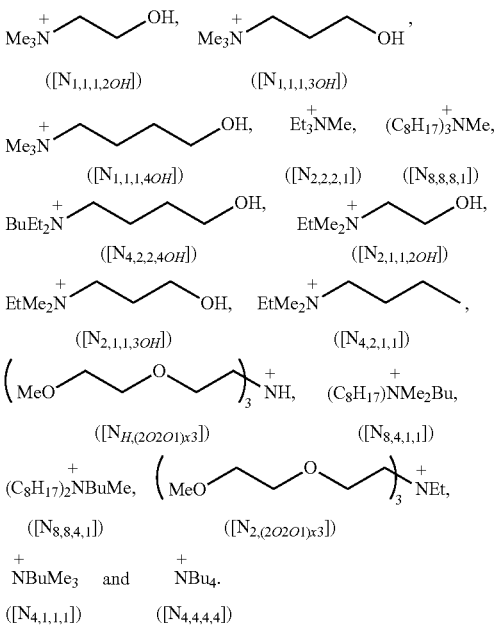
Even more preferred are ammonium cations selected from:
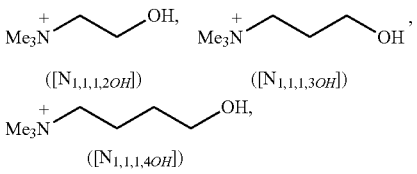
-continued
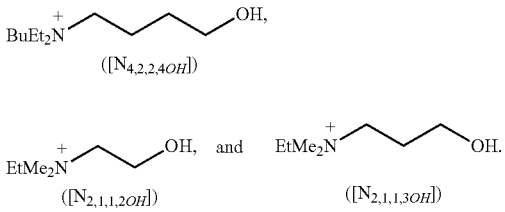
In a particularly preferred embodiment, the ammonium cation is:
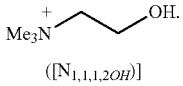
In another embodiment, $[Cat]^+$ is a heterocyclic species selected from:
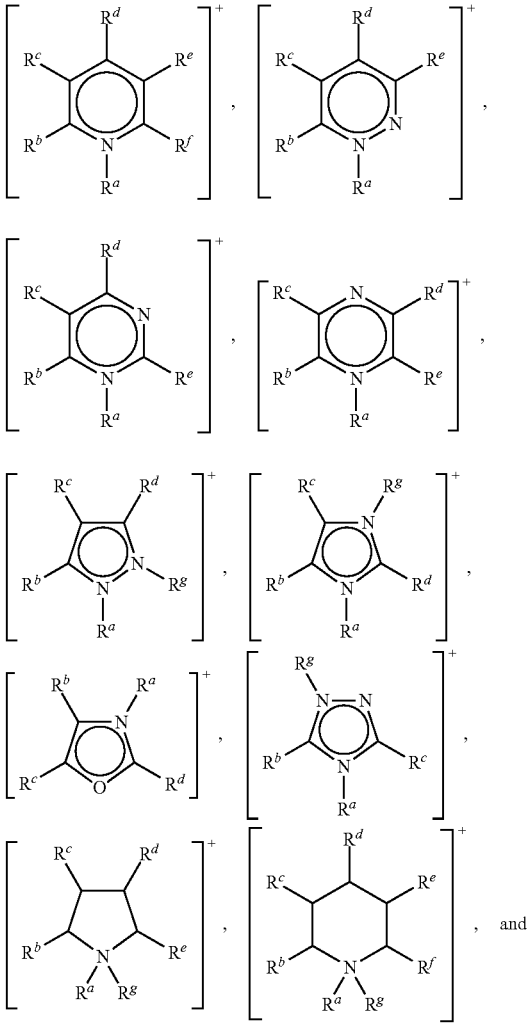

-continued

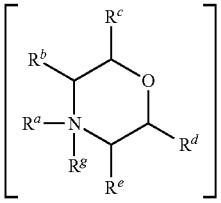

wherein: $R^a$, $R^b$, $R^c$, $R^d$, $R^e$, $R^f$, $R^g$ and $R^h$ are each independently selected from hydrogen, a $C_1$ to $C_{20}$ straight chain or branched alkyl group, a $C_3$ to $C_8$ cycloalkyl group, or a $C_6$ to $C_{10}$ aryl group, or any two of $R^b$, $R^c$, $R^d$, $R^e$ and $R^f$ attached to adjacent carbon atoms may form a methylene chain —$(CH_2)_q$— wherein q is from 3 to 6, and wherein said alkyl, cycloalkyl or aryl groups, or said methylene chain, are unsubstituted or may be substituted by one to three groups selected from: $C_1$ to $C_6$ alkoxy, $C_2$ to $C_{12}$ alkoxyalkoxy, $C_6$ to $C_{10}$ aryl, $C_2$ to $C_{15}$ straight chain or branched alkenyl, —CN, —OH, —$NO_2$, $C_7$ to $C_{10}$ aralkyl and $C_7$ to $C_{10}$ alkaryl, —$CO_2$($C_1$ to $C_6$)alkyl, —OC(O)($C_1$ to $C_6$)alkyl.

More preferably, $R^a$, $R^b$, $R^c$, $R^d$, $R^e$, $R^f$, $R^g$ and $R^h$ are each independently selected from hydrogen, a $C_1$ to $C_{20}$ straight chain or branched alkyl group, a $C_3$ to $C_8$ cycloalkyl group, or a $C_6$ to $C_{10}$ aryl group, or any two of $R^b$, $R^c$, $R^d$, $R^e$ and $R^f$ attached to adjacent carbon atoms may form a methylene chain —$(CH_2)_q$— wherein q is from 3 to 6, and wherein said alkyl, cycloalkyl or aryl groups, or said methylene chain, are unsubstituted or may be substituted by one to three groups selected from: $C_1$ to $C_6$ alkoxy, $C_2$ to $C_{12}$ alkoxyalkoxy, $C_6$ to $C_{10}$ aryl, —CN, —OH, —$NO_2$, $C_7$ to $C_{10}$ aralkyl and $C_7$ to $C_{10}$ alkaryl, —$CO_2$($C_1$ to $C_6$)alkyl, —OC(O)($C_1$ to $C_6$)alkyl.

In a further embodiment, $[Cat]^+$ may be selected from the group consisting of:

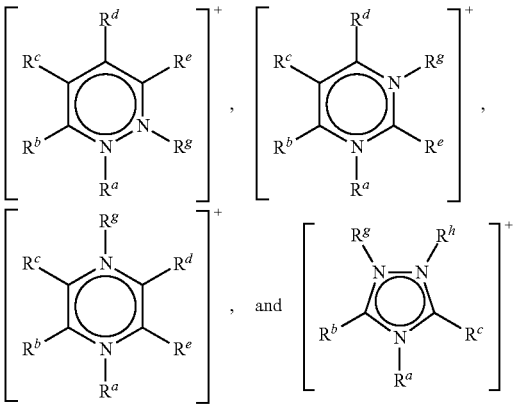

wherein $R^a$, $R^b$, $R^c$, $R^d$, $R^e$, $R^g$ and $R^h$ are as defined above.

Preferably, $R^a$ and $R^g$ are each independently selected from $C_1$ to $C_{16}$, for example $C_1$ to $C_{10}$, linear or branched alkyl, and one of $R^a$ and $R^g$ may also be hydrogen.

$R^a$ is preferably selected from $C_1$ to $C_{20}$ linear or branched alkyl, more preferably $C_2$ to $C_{20}$ linear or branched alkyl, still more preferably $C_2$ to $C_{16}$ linear or branched alkyl, and most preferably $C_4$ to $C_{10}$ linear or branched alkyl.

In the cations comprising an $R^g$ group, $R^g$ is preferably selected from $C_1$ to $C_{10}$ linear or branched alkyl, more preferably, $C_1$ to $C_5$ linear or branched alkyl, and most preferably $R^g$ is a methyl group.

In the cations comprising both a $R^a$ and an $R^g$ group, $R^a$ and $R^g$ are each preferably independently selected from $C_1$ to $C_{20}$, linear or branched, alkyl, and one of $R^a$ and $R^g$ may also be hydrogen. More preferably, one of $R^a$ and $R^g$ may be selected from $C_2$ to $C_{20}$ linear or branched alkyl, still more preferably, $C_2$ to $C_{16}$ linear or branched alkyl, and most preferably $C_4$ to $C_{10}$ linear or branched alkyl, and the other one of $R^a$ and $R^g$ may be selected from $C_1$ to $C_{10}$ linear or branched alkyl, more preferably, $C_1$ to $C_5$ linear or branched alkyl, and most preferably a methyl group.

In a further preferred embodiment, $R^a$ and $R^g$ may each be independently selected, where present, from $C_1$ to $C_{20}$ linear or branched alkyl and $C_1$ to $C_{15}$ alkoxyalkyl.

Further examples include wherein one of $R^a$ and $R^g$ is selected from ethyl, butyl, hexyl, octyl, nonyl, decyl, undecyl, dodecyl, tridecyl, tetradecyl, pentadecyl, hexadecyl, heptadecyl and octadecyl.

In further preferred embodiments, $R^b$, $R^c$, $R^d$, $R^e$, and $R^f$ are independently selected from hydrogen and $C_1$ to $C_5$ linear or branched alkyl, and more preferably $R^b$, $R^c$, $R^d$, $R^e$, and $R^f$ are hydrogen.

More preferably, $[Cat]^+$ is a cationic species selected from:

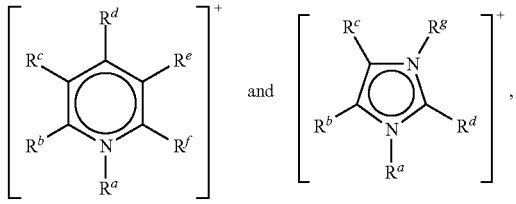

wherein $R^a$, $R^b$, $R^c$, $R^d$, $R^e$, $R^f$ and $R^g$ are as defined above.

In a particularly preferred embodiment, $[Cat]^+$ is selected from imidazolium cations having the formula:

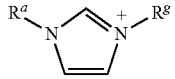

wherein $R^a$ and $R^g$ are as defined above.

For example, $[Cat]^+$ may be selected from imidazolium cations having the formula:

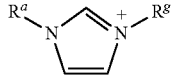

wherein $R^a$ and $R^g$ are each independently selected from a $C_1$ to $C_8$, straight chain or branched alkyl group, a $C_3$ to $C_6$ cycloalkyl group, or a $C_6$ aryl group, wherein said alkyl, cycloalkyl or aryl groups are unsubstituted or may be substituted by one to three groups selected from: $C_1$ to $C_6$ alkoxy, $C_2$ to $C_{12}$ alkoxyalkoxy, $C_6$ to $C_{10}$ aryl, —CN, —OH, —$NO_2$, —$CO_2$($C_1$ to $C_6$)alkyl, —OC(O)($C_1$ to $C_6$)alkyl, $C_7$ to $C_{10}$ aralkyl and $C_7$ to $C_{10}$ alkaryl.

Specific examples of preferred imidazolium cations suitable for use in the methods of the present invention include:

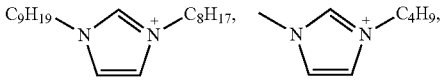

[$C_8C_9$im] [bmim]

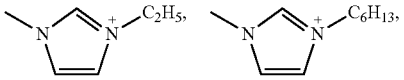

[emim] [hmim]

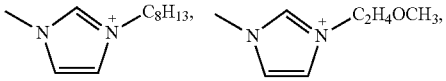

[$C_8$mim] [$MeOC_2$mim]

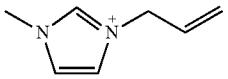

, and

[(allyl)mim]

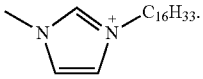

[$C_{16}$mim]

Still more preferably, $[Cat]^+$ is selected from:

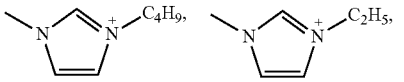

[bmim] [emim]

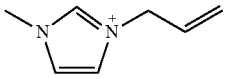

, and

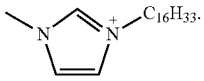

[(allyl)mim] [$C_{16}$mim]

In another preferred embodiment, $[Cat]^+$ is selected from cations having the formula:

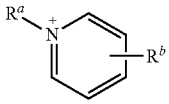

wherein $R^a$ and $R^b$ are each independently selected from a $C_1$ to $C_8$, straight chain or branched alkyl group, a $C_3$ to $C_6$ cycloalkyl group, or a $C_6$ aryl group, wherein said alkyl, cycloalkyl or aryl groups are unsubstituted or may be substituted by one to three groups selected from: $C_1$ to $C_6$ alkoxy, $C_2$ to $C_{12}$ alkoxyalkoxy, $C_6$ to $C_{10}$ aryl, —CN, —OH, —$NO_2$, —$CO_2$($C_1$ to $C_6$)alkyl, —OC(O)($C_1$ to $C_6$)alkyl, $C_7$ to $C_{10}$ aralkyl and $C_7$ to $C_{10}$ alkaryl; and wherein $R^b$ may also be hydrogen.

One example of a preferred pyridinium cation suitable for use in the methods of the present invention is:

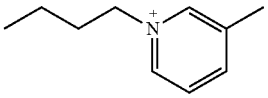

[bmpyr]

In accordance with the present invention, the ionic liquid anion $[X]^-$ may, in principle, be selected from any ionic liquid anion known in the art.

Thus, $[X]^-$ may be selected from: (i) inorganic anions, e.g. $[F]^-$, $[Cl]^-$, $[Br]^-$, $[I]^-$, $[NO_3]^-$, $[NO_2]^-$, $[BF_4]^-$, $[PF_6]^-$, $[SbF_6]^-$, $[SCN]^-$, $[H_2PO_4]^-$, $[HPO_4]^{2-}$, $[PO_4]^{3-}$, $[HSO_4]^-$, and $[SO_4]^{2-}$; (ii) sulfonate anions, e.g. $[CH_3SO_3]^-$, $[C_2H_5SO_3]^-$, $[C_8H_{17}SO_3]^-$, $[CH_3(C_6H_4)SO_3]^-$ and [docusate]$^-$ (which is also referred to as [AOT]$^-$, [bis(2-ethylhexyl)-sulfosuccinate]$^-$, and [diisooctyl sulfosuccinate]$^-$); (iii) sulphate anions, e.g. $[CH_3OSO_3]^-$, $[C_2H_5OSO_3]^-$, $[C_8H_{17}OSO_3]^-$, and $[H_3C(OCH_2CH_2)_nOSO_3]^-$ wherein n is an integer from 1 to 10; (iv) fluorinated anions, e.g. $[CF_3CO_2]^-$, $[(CF_3SO_2)_3C]^-$, $[(CF_3SO_2)_2N]^-$, $[CF_3SO_3]^-$, $[(CF_3)_2N]^-$, $[(C_2F_5)_3PF_3]^-$, $[(C_3F_7)_3PF_3]^-$ and $[(C_2F_5)_2P(O)O]^-$; (v) phosphorus anions, e.g. $[(CH_3)_2PO_4]^-[(CH_3)_2P(O)O]^-$, and $[\{(CH_3)_3CCH_2CH(CH_3)CH_2\}_2P(O)O]^-$; (vi) carboxylate anions, e.g. $[HCO_2]^-$, $[CH_3CO_2]^-$, $[CH_3CH_2CO_2]^-$, $[CH_2(OH)CO_2]^-$, and $[CH_3CH(OH)CO_2]^-$; (vii) carbonate anions, e.g. $[HCO_3]^-$, $[CO_3]^{2-}$, $[CH_3OCO_2]^-$, $[C_2H_5OCO_2]^-$; and (viii) miscellaneous anions such as $[(CN)_2N]^-$, and [saccharin]$^-$.

Preferred anions for use according to the present invention include:

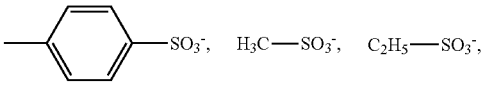

$SO_3^-$, $H_3C—SO_3^-$, $C_2H_5—SO_3^-$, $C_8H_{15}—SO_3^-$, $H_3C—OSO_3^-$, $C_2H_5—OSO_3^-$, $C_8H_{15}—OSO_3^-$, $HCO_2^-$, $CH_3CO_2^-$, $CH_3CH_2CO_2^-$, $CH_3CH(OH)CO_2^-$, $CH_3OCO_2^-$, $CH_3CH_2OCO_2^-$, $(CN)_2N^-$, $Cl^-$, $NO_3^-$, $(CF_3SO_2)_2N^-$,

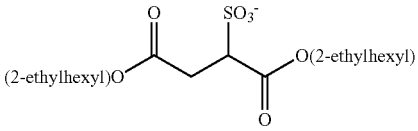

(docusate)

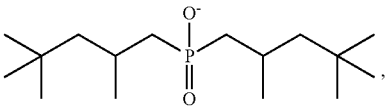

,

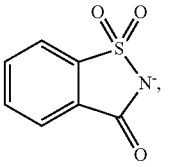

and

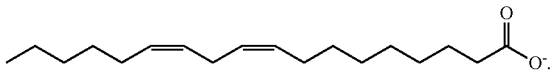

More preferably, $[X]^-$ is selected from:

$H_3C—OSO_3^-$, $C_2H_5—OSO_3^-$, $C_8H_{15}—OSO_3^-$, $CH_3CO_2^-$, $CH_3CH_2CO_2^-$, $CH_3CH(OH)CO_2^-$, $Cl^-$, $NO_3^-$, $(CF_3SO_2)_2N^-$, and

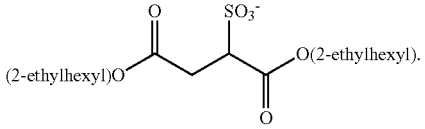

(docusate)

Still more preferably, $[X]^-$ is selected from:

$Cl^-$, $(CF_3SO_2)_2N^-$, and

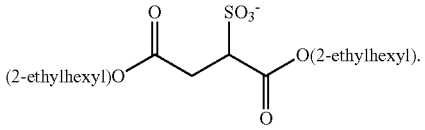

(docusate)

Most preferably, $[X]^-$ is:

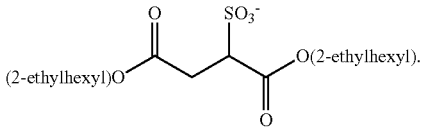

(docusate)

In a further preferred embodiment, $[X]^-$ may be selected from the group consisting of:

$[F]^-$, $[Cl]^-$, $[Br]^-$, $[I]^-$, $[HCO_3]^-$, $[CO_3]^{2-}$, $[HSO_4]^-$, $[SO_4]^{2-}$, $[H_2PO_4]^-$, $[HPO_4]^{2-}$, $[PO_4]^{3-}$ and $[NO_3]^-$.

Further examples of ionic liquids which may be used according to the present invention include choline chloride, choline docusate, 1-methyl-3-butylimidazolium docusate, 1-methyl-3-butylimidazolium bis(trifluoromethanesulfonyl) imide, 1-methyl-3-allylimidazolium docusate, 1-methyl-3-hexadecylimidazolium bis(trifluoromethanesulfonyl)imide, 1-methyl-3-hexadecylimidazolium docusate.

The present invention is not limited to ionic liquids comprising anions and cations having only a single charge. Thus, the formula $[Cat]^+[X]^-$ is intended to encompass ionic liquids comprising, for example, doubly, triply and quadruply charged anions and/or cations. The relative stoichiometric amounts of $[Cat]^+$ and $[X]^-$ in the ionic liquid are therefore not fixed, but can be varied to take account of cations and anions with multiple charges. For example, the formula $[Cat]^+[X]^-$ should be understood to include ionic liquids having the formulae $[Cat]^+_2[X]^{2-}$; $[Cat]^{2+}[X]^-_2$; $[Cat]^{2+}[X]^{2-}$; $[Cat]^+_3[X]^{3-}$; $[Cat]^{3+}[X]^-_3$ and so on.

Preferably, the ionic liquids used according to the present invention have a melting point below 100° C., more preferably below 80° C., more preferably below 60° C., still more preferably below 40° C. and most preferably below 25° C. The viscosity of the ionic liquid is not especially limited. Suitable ionic liquids may have viscosities in the range of range from 1 cP to 50,000 cP at 25° C., for instance. However, it is an advantage of the present invention that the compositions comprising ionic liquids can be formulated to have a wide variety of viscosities, depending on the desired application of the invention.

In some embodiments of the invention, it may be desirable for the composition comprising an ionic liquid to be formulated to have a viscosity in the range of 5,000 to 50,000 cP at 25° C. Such compositions have gel-like consistency and are capable of being applied as a coating on the surface of a chewing gum residue, e.g. for spot application of the composition to individual gum residues. Particularly suitable compositions for such applications may have a viscosity of at least about 15,000 cP, or at least about 25,000 cP, or even at least about 35,000 cP.

In other embodiments, it may be desirable for the ionic liquid to have a viscosity in the range of 1 cP to 5000 cP. Such compositions may be useful where it is desired that the composition be applied indiscriminately over a wide area of contamination. Particularly suitable compositions for such applications may have a viscosity of less than about 2000 cP, less than about 1000 cP, or even less than about 500 cP.

The chewing gum removal compositions used in the method of the present invention may contain co-solvents. When a co-solvent is used, it is preferably water. However, other suitable co-solvents include methanol, ethanol, and other alcohols (e.g. octanol), acetone, acetonitrile, and ethyl acetate. Preferred solvents have low toxicity and minimum hazard for use in public areas. The ionic liquid and co-solvent may be present in the chewing gum modifying composition in a weight ratio of from 5:95 to 100:0. Thus, suitable weight ratios for the ionic liquid and co-solvent in the chewing gum removal composition include 10:90, 20:80, 30:70, 40:60; 50:50; 60:40; 70:30, 90:10, 95:5, 98:2 and 99:1.

Chewing gum removal compositions used according to the method of the present invention are intended to be suitable for use in the outdoor environment, such that the ionic liquid component might be washed into groundwater or drainage systems and subsequently into streams and rivers. In addition, the chewing gum removal composition may come into contact with people or animals circulating in the areas where the chewing gum removal composition is applied. Thus, another aspect of the invention is that the ionic liquids, and compositions comprising the same, may be selected so as to be non-toxic to humans and wildlife, and environmentally benign.

In a further embodiment, the ionic liquid may comprise inorganic anions that are already widely distributed in the environment. Examples of suitable anions in this category are $[F]^-$, $[Cl]^-$, $[Br]^-$, $[I]^-$, $[HCO_3]^-$, $[CO_3]^{2-}$, $[HSO_4]^-$, $[SO_4]^{2-}$, $[H_2PO_4]^-$, $[HPO_4]^{2-}$, $[PO_4]^{3-}$ and $[NO_3]^-$, and most preferably $[Cl]^-$. However, while such anions are already present in the environment, there is some concern that excessive amounts of certain inorganic anions, particularly nitrates and phosphates, may be harmful to the environment (e.g. by contributing to eutrophication of rivers, lakes and coastal waters). The choice of anion may therefore be influenced by such factors.

In another embodiment, the pH of the composition may be controlled by the use of ionic liquids wherein the anion and/or the cation comprise acidic and/or basic moieties.

Once applied, the chewing gum removal composition is allowed to contact the chewing gum residue for a period of between one minute and two days, more preferably between five minutes and one day, and most preferably between ten minutes and one hour. For example, it may be desirable to allow the chewing gum removal composition to contact the chewing gum residue overnight in areas where public access is required.

The removal of chewing gum residues by the method of the present invention may be aided by modification of the covalent structure of the residues. As noted above, chemical modification has not been widely used in the removal of chewing gum residues because of the vigorous reaction conditions required to modify relatively inert hydrocarbon-based elastomers and waxes, and due to concerns over the use of hazardous chemicals in public places. However, it has surprisingly been found that chewing gum removal using ionic liquids can be further improved by the use of oxidising reagents which are simple to use and relatively benign to the environment.

Thus, in a further aspect the present invention provides a method for removing chewing gum residues from substrates comprising applying to a chewing gum residue a chewing gum removal composition as described above, wherein the chewing gum removal composition further comprises one or more oxidising reagents.

Preferably the oxidising reagents comprise an oxidation catalyst and an oxygen source.

Suitable oxidation catalysts for use according to this aspect of the invention include metal compounds, and more preferably metal salts. Preferred metal salts are lanthanide and transition metal salts, with transition metal salts being particularly preferred.

Examples of transition metal salts that may be used according to this aspect of the invention are iron, titanium, manganese, molybdenum, cobalt, zirconium, cerium and nickel salts. More preferably the transition metal salt is selected from Fe(II), Fe(III), Mn(VII), Mn(VI), Mo(VI), Co(II), Zr(IV), Ce(IV), and Ni(II) salts. For example, suitable salts include $Fe_2(SO_4)_3$, $(NH_4)Fe(SO_4)_2.12H_2O$, $Fe(NO_3)_3.9H_2O$, $K_2MnO_4$, $KMnO_4$, $K_2MoO_4$, $CoSO_4.7H_2O$, $CoCO_3.xH_2O$, $Zr(OH)_2CO_3.ZrO_2$, $(NH_4)_2Ce(NO_3)_6$, $(CH_3CO_2)_2Ni$.

In a preferred embodiment, the catalyst is an iron salt, more preferably a Fe(II) or Fe(III) salt, and most preferably a Fe(II) or Fe(III) chloride or sulphate salt.

In a further preferred embodiment, the catalyst is a manganese salt, more preferably a Mn(VI) or Mn(VII) salt, and most preferably a $MnO_4^{2-}$ or a $MnO_4^-$ salt. An advantage of using manganese salts is that they do not leave visible residues on treated surfaces.

Suitable oxygen sources for use according to this aspect of the invention include hydrogen peroxide and hydrogen peroxide-releasing compounds, including perborate salts, percarbonate salts, persulphate salts, perphosphate salts (for example sodium perborate, sodium percarbonate, sodium persulphate, sodium perphosphate, potassium perborate, potassium percarbonate, potassium persulphate, and potassium perphosphate), and urea peroxide. Also suitable are salts having halogen oxyanions, including hypochlorite, chlorite, chlorate, perchlorate, bromate, perbromate, iodate and periodate salts. Further suitable oxygen sources include organic hydroperoxides such as tert-butylhydroperoxide, organic peroxyacids such as peracetic acid, and organic peroxyacid salts such as sodium peracetate.

In a preferred embodiment the oxygen source is selected from hydrogen peroxide, sodium perborate, sodium percarbonate, sodium persulphate, and sodium perphosphate.

Examples of suitable combinations of oxidation catalysts and oxygen sources in accordance with this aspect of the invention include: sodium perborate and Fe(III) sulphate; sodium percarbonate and Fe(III) sulphate; and hydrogen peroxide and Fe(III) sulphate.

In accordance with this aspect of the invention, the chewing gum removal composition preferably comprises water as a cosolvent. The ionic liquid and water are preferably combined in a weight ratio of from 5:95 to 80:20, more preferably from 5:95 to 50:50, still more preferably from 5:95 to 5:20, and most preferably from 5:95 to 10:90.

The oxygen source is preferably applied in the form of an aqueous solution. Alternatively, where the oxygen source is a solid, it may be applied to the chewing gum residue as a solid, with a subsequent application of water.

In a further preferred embodiment the oxidation catalyst is premixed with the chewing gum removal composition. Most preferably the chewing gum removal composition comprising the ionic liquid and the oxidation catalyst (and preferably water) is applied to the chewing gum residue first, and the oxygen source is subsequently applied to the chewing gum residue in a separate application. Alternatively, the chewing gum removal composition comprising the oxidation catalyst may be combined with the oxygen source immediately prior to application of the resulting composition to the chewing gum residue.

Examples of preferred chewing gum removal compositions premixed with oxidation catalysts include:

(i) $[(CH_3)_3NCH_2CH_2OH]^+$[docusate]$^-$, Fe(III) sulphate, and water premixed in a weight ratio of 1:3:10; and (ii) $[(CH_3)_3NCH_2CH_2OH]^+$[chloride]$^-$, sodium dodecylsulphate, Fe(III) sulphate, and water premixed in a weight ratio of 0.75:1.5:3:10.

In accordance with this aspect of the invention, the chewing gum removal composition and the oxidising reagents are preferably contacted with the chewing gum residue for a period of from 1 minute to 1 hour, more preferably from 1 minute to 30 minutes, still more preferably from 1 minute to 20 minutes, and most preferably from 1 minute to 10 minutes. However, it will be appreciated that the contact time is dependent on the choice of chewing gum removal composition and oxidising reagents as well as the age and type of the chewing gum residue. Suitable contacting timescales can be routinely determined by skilled persons.

In a further embodiment, the chewing gum residue may optionally be pretreated before treatment with the oxidising reagents. Suitable pretreating agents include ionic liquids and organic solvents. For example, the pretreating agent may be selected from limonene, methanol, octanol, 2,2,4-trimethylpentane, hexadecane, toluene, choline docusate, or mixtures thereof. Without being bound by any specific theory, it is believed that such a pretreatment step disrupts the polymeric matrix of the chewing gum residue making it more accessible to the oxidising reagents applied in a subsequent step. Such a pretreatment step preferably takes place between 10 minutes and 12 hours before the oxidation step.

Once the chewing gum removal composition and the oxidising reagents (if used) have been contacted with chewing gum residues for a suitable period of time, the chewing gum residues become softened and their adhesion to surfaces is reduced. The resulting softened chewing gum residues may therefore be removed by techniques including scrubbing, brushing, spraying with low pressure water, or simply allowing the residue to be removed in due course by rainfall. In one preferred embodiment, the products formed by degradation of the chewing gum residue are water soluble. When the chewing gum residue is in a location where public access is required, removal of the softened residue preferably takes place soon after application of the chewing gum removal composition (e.g. by scrubbing, brushing or spraying with low pressure water) to avoid the softened gum residues being transferred to the soles of shoes or to clothing.

In addition to the ionic liquid, and optionally the oxidising reagents, the chewing gum removal compositions used in the methods of the present invention as defined above may comprise various additives, such as surfactants, viscosity modifiers, emulsifiers, melting point suppressants and wetting agents. A wide variety of such additives are known in the art, and the skilled person is capable of selecting suitable additives as necessary for a particular application.

As an alternative to the use of oxidising reagents, it has also surprisingly been found that ionic liquid compositions comprising enzymes may be used to modify chewing gum residues.

Enzymes are biomolecules found in living cells that catalyse chemical reactions. All enzymes are protein-based, and are therefore safe to use, and environmentally benign. Like all catalysts, enzymes work by lowering the activation energy of a reaction, thus dramatically increasing the rate of the reaction—enzyme-catalysed reaction rates may be of the order of one million times faster than those of comparable uncatalysed reactions. Many enzymes can be isolated from the parent cells and obtained in substantially pure form. Enzymes are often stable in aqueous or organic solutions, and may be used to catalyse chemical transformations under mild conditions.

Enzyme activity is often influenced by other molecules—inhibitors are molecules that decrease enzyme activity, and activators are molecules that increase activity. The activity of enzymes may also be affected by temperature, chemical environment (e.g. pH) and the concentration of the substrate. Some enzymes do not need any additional components to show full activity. However, others require an auxiliary substrate called a cofactor in order to be active, for example NADH, NADPH, NAD or NADP. Preferred enzymes for use in the methods of the present invention are cofactor-independent enzymes. Certain enzymes may act on a substrate called a mediator to convert it into a reactive species. The reactive species may then react with a target chemical substance. Thus, the enzyme acts as a catalyst to initiate the mediated reaction on the target chemical substance.

Thus, in another aspect, the present invention provides a method for removing chewing gum residues from substrates comprising applying to a chewing gum residue a composition comprising an ionic liquid as defined above, one or more enzymes and a mediator, wherein the composition is capable of converting the chewing gum residue into a modified material that is more easily removed from substrates. The invention further provides novel compositions comprising an ionic liquid and one or more enzymes. Generally, compositions comprising enzymes have been found to be more effective for the removal of chewing gum residues than the use of ionic liquids alone.

Preferably, the enzymes are capable of covalently modifying the components of chewing gum, e.g. elastomers, plasticisers, softeners and waxes as described above.

Without being bound by any particular mechanism, it is believed that ionic liquid component of the elastomer removal composition is capable of penetrating chewing gum residues and disrupting non-covalent interactions between the components of the residues, thus allowing the enzymes and/or the mediators access to the polymers and other components of the gum residue. It should be noted that enzymes and mediators are usually used in aqueous formulations, in which form hydrophobic chewing gum residues are poorly accessible to the enzymes and mediators.

Classes of enzymes that have been found to be effective for the removal of chewing gum residues in accordance with the present invention include laccases, peroxidases, ligninases, and lipoxygenases. Specific enzymes that have been found to be useful in the methods of the present invention include the fungal laccases from *Trametes versicolor* and *Agaricus bisporus*, horseradish peroxidase, manganese peroxidase from *Phanerochaete chrysosporium*, hydroquinone peroxidase from *Azotobacter beijerinckii*, and soybean lipoxygenases. Preferably the enzyme is selected from laccases and lipoxygenases. More preferably the enzyme is a laccase. Still more preferably the enzyme is selected from laccase from *Trametes versicolor* and laccase from *Agaricus bisporus*, and most preferably the enzyme is laccase from *Trametes versicolor.*

In addition to the natural enzymes mentioned above, chemically modified versions of those enzymes may also be used in the methods of the present invention. It is well known in the art that enzymes can be chemically modified so as to alter their properties. Such modifications can change the hydrophobicity of the enzymes and change their conformation, possibly resulting in improved activity, stability, specificity and solubility relative to the unmodified enzyme. Methods for the modification of enzymes that are known in the art include, inter alia, the replacement of amino acids in the enzyme structure with other naturally occurring or synthetic amino acids or amino acid substitute groups, or the attachment of side chains.

These enzymes operate by catalysing one-electron oxidations of electron-rich mediators. In the case of laccase and lipoxygenase enzymes, the oxidising agent is elemental oxygen, whereas the oxidising agent for peroxidase and ligninase enzymes is hydrogen peroxide. Thus, in the embodiments of the invention which use peroxidase and/or ligninase enzymes it is necessary to also apply hydrogen peroxide to the chewing gum residue. This may be applied separately from the composition comprising the ionic liquid and the enzyme, or more preferably the hydrogen peroxide is premixed with the composition comprising the ionic liquid and the enzyme before application to the chewing gum residue. Laccase and lipoxygenase enzymes, are able to use atmospheric oxygen as the oxygen source, and are therefore preferred.

The mediators spontaneously form reactive free radicals after abstraction of the electron by the enzyme. Classes of compounds suitable for use as mediators include various phenols, amines, fatty acids, and N-hydroxy compounds, among others. The oxidised mediator catalyses a wide range of oxidations, oxidising any molecule it comes into contact with. The overall reaction may be illustrated as follows:

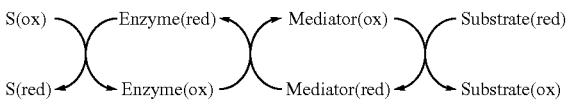

wherein: S(ox)=$O_2$ for laccase and lipoxygenase, $H_2O_2$ for peroxidase and lipoxygenase; and (ox) indicates the oxidised form and (red) indicates the reduced form.

The present invention encompasses the use of mediators which can be recycled through a continuous oxidation/reduction cycle, in which the oxidised form is reduced back to its original state as it initiates reaction of the chewing gum residue, as shown above. Many enzyme mediators in this category are known to the person skilled in the art, and representative examples of suitable mediators are:

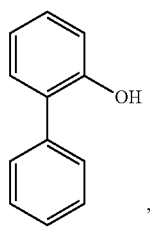

2-hydroxybiphenyl

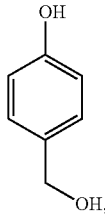

4-hydroxybenzyl alcohol

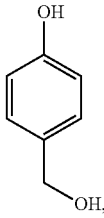

4-methoxybenzyl alcohol

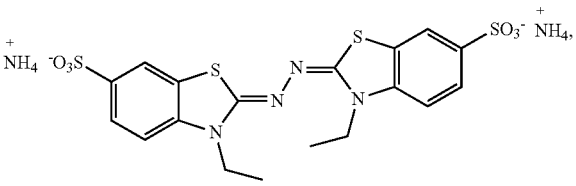

2,2′-azine-bis(3-ethylbenzothiazoline-6-sulfonic acid) (ABTS)

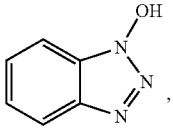

1-hydroxybenzotriazole

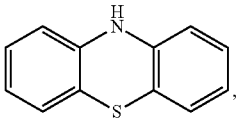

10-H-phenothazine

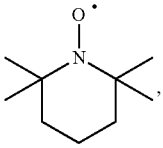

2,2,6,6-tetramethyl-1-piperadinyloxyl (TEMPO)

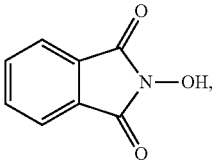

N-hydroxyphthaleimide

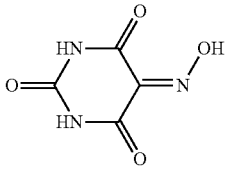

violuric acid and

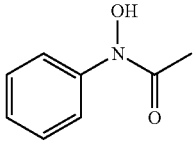

N-hydroxyacetanilide

The invention also encompasses the use of mediators which can only be oxidised once, known as sacrificial mediators. The oxidised form initiates reaction of the chewing gum residue but then does not return to its original state and is lost. An example of a sacrificial mediator is linoleic acid and the corresponding linoleate anion:

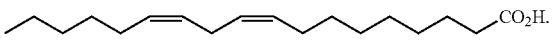

Linoleic acid

As noted above, the linoleate anion is also suitable as the ionic liquid anion. Thus, in certain embodiments of the invention, the ionic liquid anion may also be the mediator.

The exact mechanisms by which such processes break down the components of chewing gum residues are complex, due to the large number of components that are typically present in chewing gum residues, and hence the large number of different covalent and non-covalent interactions. As an example, and without wishing to be bound by any particular theory, it is believed that degradation of a chewing gum residue comprising polyisoprene by ionic liquids comprising a laccase enzyme and a mediator may involve oxidative scission of the polyisoprene polymer at the cis-1,4-double bonds to produce a ketone and an aldehyde.

The amount of mediator required in the methods of the present invention is typically quite low because, in the absence of side reactions, the mediators are capable of performing many reaction cycles without degradation. For instance, suitable concentrations of mediator in the ionic liquid composition may be in the range of 0.0001 to 0.1 moldm$^{-3}$, more preferably 0.0005 to 0.05 moldm$^{-3}$, still more preferably 0.001 to 0.01 moldm$^{-3}$, and most preferably around 0.005 moldm$^{-3}$. These ranges are considered to be non-limiting, however, and the use of higher or lower concentrations of mediator is considered to be within the scope of the invention.

Preferably, appropriate quantities of mediator are included in the enzyme-containing ionic liquid compositions of the present invention. However, the mediators may be applied to the chewing gum residue separately from the enzyme-containing ionic liquid composition.

In a preferred embodiment, the method of the present invention is used to obtain a modified chewing gum residue that is more fluid, less adhesive and less cohesive, and therefore more easily removed from a substrate, e.g. by low pressure hosing. This result may be obtained by using a mediator selected from 2-hydroxybiphenyl, 4-hydroxybenzyl alcohol, 4-methoxybenzyl alcohol, ABTS, 1-hydroxybenzotriazole, TEMPO, linoleic acid, N-hydroxyphthaleimide, violuric acid, or N-hydroxyacetanilide, together with an enzyme-containing ionic liquid composition as described above. It has been found that the use of these mediators causes cleavage of the polymers in chewing gum residues to form fragments of lower molecular weight. However, other forms of covalent modification, such as hydroxylation of the polymers in the residue, may have a significant effect on the fluidity of the modified chewing gum residue, and it is not excluded that such processes may also occur.

Suitable methods for removing softened chewing gum residues include scrubbing, brushing, spraying with low pressure water, or simply allowing the residue to be removed in due course by rainfall. In one preferred embodiment, the products formed by degradation of the chewing gum residue are water soluble. When the chewing gum residue is in a location where public access is required, removal of the softened residue preferably takes place soon after application of the ionic liquid composition (e.g. by scrubbing, brushing or spraying with low pressure water) to avoid the softened gum residues being transferred to the soles of shoes or to clothing.

In another preferred embodiment, the method of the present invention is used to obtain a hardened chewing gum residue. It is thought that hardening of chewing gum occurs when the enzyme and mediator cause crosslinking the various compounds of a chewing gum residue to form compounds of increased molecular weight. This result may be obtained by using 10-H-phenothiazine as the mediator, together with an enzyme-containing ionic liquid composition as described above. The modified chewing gum residue is harder and more brittle than the original residue, and the increase in molecular weight is generally accompanied by a reduction in polymer-substrate interactions. The brittle residue can be detached from the substrate when a physical force is applied, e.g. sweeping or hosing with low pressure water, or the residue can be fragmented by application of a physical force, followed by sweeping, vacuuming or hosing of the fragments from the substrate. Alternatively, the hardened residue may be detached from the substrate by wind and rain, or eroded from the substrate by pedestrians.

In further embodiments, the methods of the present invention may also comprise the use of other enzymes, such as esterases and lipases. As noted above, many chewing gum compositions contain polyvinyl acetate. Polyvinyl acetate contains ester groups which can be hydrolysed efficiently by commercially available, cofactor-independent esterases. The reaction product is polyvinylalcohol, which is water soluble and biodegradable. Esterase enzymes are also active against the glycerol esters, triacetin and triglycerides that are often present in gum bases as softeners. Thus, in one embodiment of the present invention, the ionic liquid composition comprises an esterase enzyme.

The degradation of polyvinyl acetate is also catalysed by para-toluenesulfonic acid. Accordingly, in another embodiment of the invention, non-enzymatic hydrolysis of polyvinyl alcohol is catalysed by an ionic liquid comprising a para-toluenesulfonate anion.

Enzyme activity can sometimes be sensitive to environmental factors, such as temperature and the chemical environment—particularly pH. Preferably the enzymes are active at ambient outdoor temperatures, e.g. between 0 and 40° C., more preferably between 10 and 25° C. For laccase enzymes, the pH is preferably maintained in the range of 3 to 7, more preferably 4 to 6, and most preferably about 4.5. For the peroxidase and lipoxygenase enzymes, the pH is preferably maintained in the range of 5.0 to 9.0, more preferably 5.5 to 7.0, and most preferably 6.0 to 6.5. In a preferred embodiment, the ionic liquid composition comprises a buffer component to maintain the pH within a desired range. A wide range of suitable buffers are known to the person skilled in the art, and phosphate or citrate buffers may be mentioned as examples.

In another preferred embodiment, the pH of the composition may be controlled by the use of ionic liquids wherein the anion and/or the cation comprise acidic and/or basic moieties.

An important consideration in preparing ionic liquids comprising enzymes for use in the methods of the present invention is the activity of the enzyme in the presence of the ionic liquid. The compatibility of enzymes and ionic liquids can be easily determined by the skilled person by standard laboratory techniques. One suitable technique uses high throughput screening of ionic liquids and enzymes using multiple well plates. A standard enzyme-catalysed transformation may be used to analyse the activity of a particular enzyme in the presence of various ionic liquids at various concentrations. One suitable reaction is the oxidation of catechol to 1,2-benzoquinone. The progress of this reaction can be monitored visually by the dark colour of 1,2-benzoquinone and spectrally, for instance using UV-Vis spectrometry. This transformation can be represented by the following reaction scheme, in which laccase is exemplified:

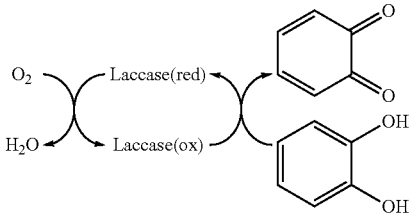

Ionic liquid compositions for use according to the present invention typically comprise at least 10% by weight ionic liquid in water without loss of enzyme activity, although in some embodiments the compositions may comprise at least 20%, alternatively at least 30%, alternatively above 50% by weight of the ionic liquid. For example, for some combinations of ionic liquids and enzymes, enzyme activity is maintained when the composition comprises from 70 to 90% by weight of the ionic liquid in water. Preferably, however, the composition comprises between 10 and 30% by weight ionic liquid in water, more preferably between 15 and 25% by weight.

The ionic liquid compositions used in the methods of the present invention as defined above may also comprise various additives, such as surfactants, viscosity modifiers, emulsifiers, melting point suppressants and wetting agents. A wide variety of such additives are known in the art, and the skilled person is capable of selecting suitable additives as necessary for a particular application. Of course, it may be necessary to screen potential additives for compatibility with the oxidising reagents or the enzymes used, and this may be easily undertaken by the skilled person using routine methods of analysis, e.g. using high throughput screening on multiple well plates, as described above.

The methods of the current invention may be used to remove chewing gum residues from a wide variety of substrate materials without damage to the underlying substrate. Examples include stone, concrete, cement, bricks, gypsum plaster, clay, ceramics, glass, asphalt, tarmac, bitumen, metals, wood, lacquer and textiles.

In accordance with the present invention, chewing gum removal compositions may be applied to chewing gum residues by any method known to the skilled person. Non-limiting examples of such application methods include spraying (e.g. as an aerosol), dipping, brushing and pouring. In one preferred embodiment, the composition can be sprayed under pressure from a portable reservoir via a nozzle mounted on a hand-held spraying lance. Alternatively, the composition can be applied from spray nozzles mounted on a motorised vehicle. In another preferred embodiment, the composition is supplied in aerosol spray cans.

The present invention also provides a kit of parts for use in removing chewing gum residues from substrates comprising:

(i) a first part comprising an ionic liquid as defined above;

(ii) a second part comprising an oxidation catalyst as defined above, the second part being optionally combined with the first part; and (iii) an oxygen source as defined above as a third part.

The present invention further provides a kit of parts for preparing an enzyme-containing ionic liquid composition as described above for use in removing chewing gum residues from substrates, the kit comprising:

(i) a first part comprising an ionic liquid as defined above;

(ii) a second part comprising one or more natural or modified enzymes selected from: laccases, lipoxygenases, peroxidases and ligninases;

(iii) a third part comprising one or more enzyme mediator compounds, the third part may optionally be combined with the first part or the third part.

The present invention also provides novel compositions comprising:

(i) an ionic liquid having the formula $[Cat]^+[X]^-$, wherein $[X]^-$ is an anionic species as defined above and $[Cat]^+$ has the formula:

$$[N(R^a)(R^b)(R^c)(R^d)]^+ \text{ and } [P(R^a)(R^b)(R^c)(R^d)]^+$$

wherein $R^a$, $R^b$, $R^c$, and $R^d$ are each independently selected from a $C_1$ to $C_{15}$ straight chain or branched alkyl group, a $C_3$ to $C_8$ cycloalkyl group, or a $C_6$ to $C_{10}$ aryl group, wherein said alkyl, cycloalkyl or aryl groups are unsubstituted or may be substituted by one to three groups selected from: $C_1$ to $C_6$ alkoxy, $C_2$ to $C_{12}$ alkoxyalkoxy, $C_6$ to $C_{10}$ aryl, $C_2$ to $C_{15}$ straight chain or branched alkenyl, —CN, —OH, —$NO_2$, —$CO_2$($C_1$ to $C_6$)alkyl, —OC(O)($C_1$ to $C_6$)alkyl, $C_7$ to $C_{30}$ aralkyl and $C_7$ to $C_{30}$ alkaryl, and wherein $R^b$ may also be hydrogen; and (ii) one or more natural or modified enzymes selected from: laccases, peroxidases, lipoxygenases, and lignin-ases.

In a preferred embodiment, $[Cat]^+$ has the formula:

$$[N(R^a)(R^b)(R^c)(R^d)]^+$$

wherein $R^a$, $R^b$, $R^c$, and $R^d$ are each independently selected from a $C_1$ to $C_{15}$ straight chain or branched alkyl group, a $C_3$ to $C_8$ cycloalkyl group, or a $C_6$ to $C_{10}$ aryl group, wherein said alkyl, cycloalkyl or aryl groups are unsubstituted or may be substituted by one to three groups selected from: $C_1$ to $C_6$ alkoxy, $C_2$ to $C_{12}$ alkoxyalkoxy, $C_6$ to $C_{10}$ aryl, $C_2$ to $C_{15}$ straight chain or branched alkenyl, —CN, —OH, —$NO_2$, —$CO_2$($C_1$ to $C_6$)alkyl, —OC(O)($C_1$ to $C_6$)alkyl, $C_7$ to $C_{30}$ aralkyl and $C_7$ to $C_{30}$ alkaryl, and wherein $R^b$ may also be hydrogen In a more preferred embodiment, $[Cat]^+$ has the formula:

$$[N(R^a)(R^b)(R^c)(R^d)]^+$$

wherein $R^a$, $R^b$, $R^c$, $R^d$ and $R^g$ are each independently selected from a $C_1$ to $C_8$, straight chain or branched alkyl group, a $C_3$ to $C_6$ cycloalkyl group, or a $C_6$ aryl group, wherein said alkyl, cycloalkyl or aryl groups are unsubstituted or may be substituted by one to three groups selected from: $C_1$ to $C_6$ alkoxy, $C_2$ to $C_{12}$ alkoxyalkoxy, $C_6$ to $C_{10}$ aryl, CN, OH, $NO_2$, —$CO_2$($C_1$ to $C_6$)alkyl, —OC(O)($C_1$ to $C_6$)alkyl, $C_7$ to $C_{10}$ aralkyl, and $C_7$ to $C_{10}$ alkaryl, and wherein $R^b$ may also be hydrogen.

Even more preferred, are ionic liquids wherein $[Cat]^+$ is selected from:

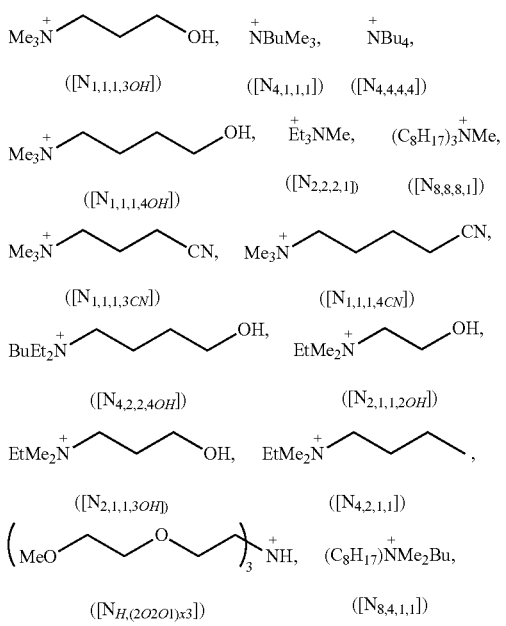

-continued

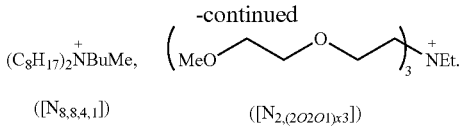

The present invention further provides novel compositions comprising:

(i) an ionic liquid having the formula $[Cat]^+[X]^-$, wherein $[Cat]^+$ is a cationic species as defined above and $[X]^-$ is selected from:

$[F]^-$, $[Cl]^-$, $[I]^-$, $[NO_3]^-$, $[NO_2]^-$, $[SbF_6]^-$, $[SCN]^-$, $[H_2PO_4]^-$, $[HPO_4]^{2-}$, $[PO_4]^{3-}$ $[HSO_4]^-$, $[SO_4]^{2-}$, $[CH_3SO_3]^-$, $[C_2H_5SO_3]^-$, $[C_8H_{17}SO_3]^-$, $[CH_3(C_6H_4)SO_3]^-$, [docusate]$^-$, $[C_8H_{17}OSO_3]^-$, wherein n is an integer from 1 to 10, $[CF_3CO_2]^-$, $[(CF_3SO_2)_3C]^-$, $[(CF_3SO_2)_2N]^-$, $[CF_3SO_3]^-$, $[(CF_3)_2N]^-$, $[(C_2F_5)_3PF_3]^-$, $[(C_3F_7)_3PF_3]^-$, $[(C_2F_5)_2P(O)O]^-$, $[(CH_3)_2PO_4]^-$, $[(CH_3)_2P(O)O]^-$, $[\{(CH_3)_3CCH_2CH(CH_3)CH_2\}_2P(O)O]^-$, $[HCO_2]^-$, $[CH_3CO_2]^-$, $[CH_3CH_2CO_2]^-$, $[CH_2(OH)CO_2]^-$, $[CH_3CH(OH)CO_2]^-$, $[HCO_3]^-$, $[CO_3]^{2-}$, $[CH_3OCO_2]^-$, $[C_2H_5OCO_2]^-$, [saccharin]$^-$, and [linoleate]$^-$; and (ii) one or more natural or modified enzymes selected from: laccases, peroxidases, lipoxygenases, and lignin-ases.

Most preferably $[X]^-$ is [docusate]$^-$.

In the above compositions, examples of suitable enzymes include: laccase from *Trametes versicolor*, laccase from *Agaricus bisporus*, horseradish peroxidase, manganese peroxidase from *Phanerochaete chrysosporium*, hydroquinone peroxidase from *Azotobacter beijerinckii*, and soybean lipoxygenase. The enzyme is preferably selected from laccases and lipoxygenases. More preferably the enzyme is a laccase. Still more preferably the enzyme is selected from laccase from *Trametes versicolor* and laccase from *Agaricus bisporus*, and most preferably the enzyme is laccase from *Trametes versicolor*.

In yet another preferred embodiment, the above compositions comprise one or more enzyme mediator compounds. Most preferably the enzyme mediator compounds are selected from:

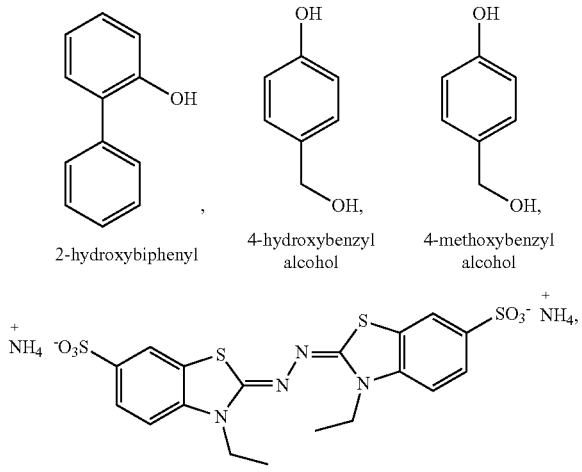

-continued

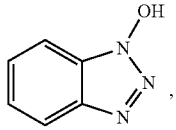

1-hydroxybenzotriazole

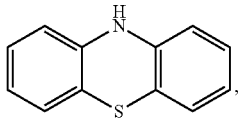

10-H-phenothazine

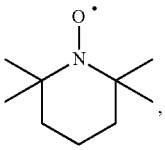

2,2,6,6-tetramethyl-1-piperadinyloxyl (TEMPO)

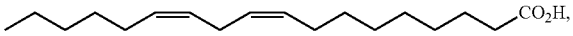

Linoleic acid

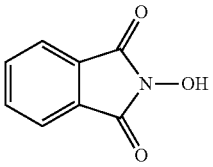

N-hydroxyphthaleimide

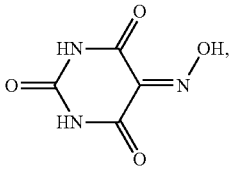

violuric acid

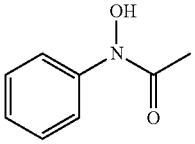

N-hydroxyacetanilide

The present invention further provides the use of ionic liquids and ionic liquid compositions as defined above for removing chewing gum residues from substrates.

EXAMPLES

Example 1

Chewing gum samples of known mass were prepared by dissolving 50 g $dm^{-3}$ of a chewing gum residue in chloroform. The resulting solution (200 μL) was added to a glass vial (5 mL volume, 1 cm diameter) and the chloroform was allowed to evaporate to provide a chewing gum film (approximately 10 mg) in the glass vial. The resulting film was strongly adhered to the inside of the vial and could not be removed by rinsing with water.

Example 2

To a chewing gum film prepared according to Example 1 was added 1 mL of the ionic liquid [emim][docusate]. The vial was capped and the mixture allowed was allowed to stand at room temperature. After 1 day the chewing gum film was significantly swollen, had reduced density, and could be washed away with water, forming a viscous solution.

Example 3

To a chewing gum film prepared according to Example 1 was added 1 mL of the ionic liquid [bmim][docusate], the vial was capped and the mixture was allowed to stand at room temperature. After 1 day the chewing gum film was significantly swollen, had reduced density, and could be washed away with water.

Example 4

Samples of chewing gum residues (~0.5 g) on the surface of a concrete slab were treated with 1 mL of [emim][docusate] or [bmim][docusate] contained in an upturned vial pressed into the surface of the gum. The vial diameter was 1 cm and approximately 10% of the available chewing gum surface was treated, with the rest of the gum being untreated. After standing at room temperature for 1 day, the vials were removed. The portion of the gum residue treated by each of the ionic liquids was found to be swollen and significantly more fluid than the surrounding untreated gum, and could be washed from the surface of the concrete slab with water.

Example 5

A chewing gum removal composition was prepared by dissolving 10 g of $[(CH_3)_3NCH_2CH_2OH]^+[docusate]^-$ in 100 g of hot water and subsequently adding 30 g of iron(III) sulphate.

Example 6

To a chewing gum residue (approx. 0.5 g) in a test tube was added 5.0 mL of the composition prepared in Example 5. The resulting mixture was heated gently to 50° C. then removed from the heat before aqueous hydrogen peroxide (30 wt %, 1 mL) was added dropwise.

Example 7

The chewing gum removal composition of Example 5 (3.0 mL) was applied to a chewing gum residue (~0.5 g) on the surface of a concrete slab and then 30 wt % hydrogen peroxide solution in water (1.5 mL) was slowly applied to the chewing gum residue. The chewing gum removal composition and the hydrogen peroxide were allowed to remain in contact with the chewing gum residue for a period of 10 minutes after which time the chewing gum residue was easily removed from the surface with a wire brush or by rinsing with low pressure water.

Example 8

A chewing gum removal composition was prepared by dissolving 15 g of sodium dodecylsulphate in 100 g of hot water and subsequently adding 7.5 g of $[(CH_3)_3NCH_2CH_2OH]^+[Cl]^-$ and 30 g of iron(III) sulphate.

Example 9

To a chewing gum residue (approx. 0.5 g) in a test tube was added 0.5 g of sodium perborate, followed by 5.0 mL of the composition prepared in Example 8. The resulting mixture was heated gently to 50° C.

Example 10

Solid sodium perborate (approximately 0.5 g) was applied to a chewing gum residue (~0.5 g) on the surface of a concrete slab and the chewing gum removal composition of Example 8 (1.0 mL) was slowly applied (foaming was observed). The chewing gum removal composition and the sodium perborate were allowed to remain in contact with the chewing gum residue for a period of 10 minutes after which time the chewing gum residue was easily removed from the surface with a wire brush or by rinsing with low pressure water.

Example 11

A chewing gum residue (~0.5 g) on the surface of a concrete slab was pretreated by washing with soap and water and then by rubbing on a viscous mixture of choline diisooctylsulfosuccinate (3.0 g) and octanol (1.0 mL). The mixture of choline diisooctylsulfosuccinate and octanol was allowed to remain in contact with the chewing gum residue for a period of 2 hours. The application of choline diisooctylsulfosuccinate and octanol was repeated three times and then the residue was allowed to remain in contact with the choline diisooctylsulfosuccinate and octanol overnight. The resulting residue was then rubbed with octane before solid sodium perborate (0.5 g) and solid Fe(III) sulphate (2.0 g) was added, followed by choline diisooctylsulfosuccinate (2.0 mL) and hydrogen peroxide (2.0 mL). The mixture was allowed to react for a period of 10 minutes, after which time the residue was easily removed from the surface of the concrete slab using a wire brush, or by rinsing with water.

Example 12

Solid sodium perborate (approximately 0.9 g) was applied to a chewing gum residue (~0.5 g) on the surface o a concrete slab and an aqueous solution of $KMnO_4$ (2 mL, ~63 mM) was applied. After 1 minute, $H_2O_2$ (5 mL, 35% aqueous solution) was added dropwise over a period of 1-2 minutes. When the effervescence ceased, the residue was rinsed with water and the application of permanganate and $H_2O_2$ was repeated. After the second application, the chewing gum residue was visibly softened and easily removed from the surface of the slab with a wire brush or spatula, or by rinsing with low pressure water.

Example 13

Samples of chewing gum residues (0.5 g) on the surface of a concrete slab were treated with 1 mL of a chewing gum modifying composition comprising laccase from *Trametes versicolor* (4 mg $mL^{-1}$) and 20 wt % [$N_{2,(2O2O1)x3}$][Linoleate] in citric acid buffer (pH 4.5) and TEMPO (5 mM) contained in a upturned vial pressed into the surface of the gum residue. A second vial pressed into the surface of a second gum residue contained 1 mL of a chewing gum modifying composition comprising laccase from *Trametes versicolor* (4 mg $mL^{-1}$) and 20 wt % of a mixture of [$N_{4,4,4,4}$][docusate] (95%) and [$N_{2,(2O2O1)x3}$][Linoleate] (5%) in citric acid buffer (pH 4.5) and TEMPO (5 mM). After standing at room temperature for 1 day the vials were removed. The average molecular weight of the chewing gum was reduced by 80% in the presence of pure [$N_{2,(2O2O1)x3}$][Linoleate], and by 50% in the presence of the ionic liquid mixture.

Example 14

Chewing gum films prepared according to Example 1 were treated with a chewing gum modifying composition comprising laccase from *Trametes versicolor* (0.4 mg $mL^{-1}$) in 20 wt % [emim][docusate] in 20 mM citric acid buffer (pH 4.5) (1 mL) and an enzyme mediator compound (5 mM). A control sample contained no enzyme mediator compound. The gum was partially dissolved to form a turbid solution. Samples of the gum were removed after 72 hours and the change in average molecular weight of each of the gums for each of a series of mediators was measured using gel permeation chromatography. The results are shown in Table 1, expressed as a percentage of the average molecular weight of the starting gum.

TABLE 1

| Mediator | Observations after 72 h |
|---|---|
| None (control) | No change in molecular weight distribution |
| 2-hydroxybiphenyl | Residue of fragments with 54% and 45% of initial molecular weight |
| p-hydroxybenzyl alcohol | Residue of fragments with 60%, 45%, 39% and 30% of initial molecular weight |
| 4-methoxybenzyl alcohol | Residue of fragments with 60% of initial molecular weight |
| 10-H-phenothiazine | Chewing gum fully detached from glass surface. Large solid flakes were obtained. Molecular weight distribution could not be measured due to insolubility of the flakes. |
| TEMPO | Chewing gum fully dissolved in water, no residue to measure molecular weight distribution |
| ABTS | Chewing gum fully dissolved in water, no residue to measure molecular weight distribution |

Example 15

Samples of chewing gum residues 0.5 g on the surface of a concrete slab were treated with chewing gum modifying compositions comprising laccase from *Trametes versicolor* (4 mg $mL^{-1}$) and various mediators (5 mM) in a mixture of 20 wt % [emim][docusate] in 20 mM citric acid buffer (pH 4.5) (1 mL) contained in an upturned vial pressed into the surface of the gum. A control vial contained the same composition (including the enzyme), but no enzyme mediator compound. Further vials each contained one of the following mediators: 2-hydroxybiphenyl, p-hydroxybenzyl alcohol, 4-methoxybenzyl alcohol, TEMPO, and ABTS. After standing at room temperature for 1 day, the vials were removed. In each case, the portion of the gum residue treated by each of the ionic liquid compositions was found to be swollen and significantly more fluid than the surrounding untreated gum. However, the swelling was less for the control sample, which was also found to be more adherent to the surface of the slab than the samples treated in the presence of the various mediators. For the samples treated in the presence of enzyme and mediators, the treated portion of the gum was easily rinsed from the surface of the concrete slab, leaving no residue behind, while the surrounding untreated portions of the gum remained firmly adhered the surface of the slab. For the control sample, it was necessary to use water pressure to detach the residue from the slab.

Example 16

Chewing gum films prepared according to Example 1 were treated with 1 mL of chewing gum modifying composition comprising laccase from *Trametes versicolor* (4 mg $mL^{-1}$) in 20 mM citric acid buffer (pH 4.5) comprising 20 wt % of either [$C_6$mim][$NTf_2$], [$N_{8,8,8,1}$][Cl], or [$N_{4,4,4,4}$][docusate]. A control sample contained no enzyme mediator compound, and further samples contained various different mediators. Samples of the gum were removed after 72 hours and the change in average molecular weight of each of the gums was measured using gel permeation chromatography. The samples containing 10-H-phenothiazine resulted in brittle chewing gum residues with a molecular weight distribution broadened towards higher molecular weight polymers.

Example 17

Samples of chewing gum residues 0.5 g on the surface of a concrete slab were treated with 1 mL of chewing gum modifying composition comprising laccase from *Trametes versicolor* (4 mg $mL^{-1}$) in citric acid buffer (pH 4.5) comprising 20 wt % of $[N_{4,4,4,4}]$[docusate] and 10-H-phenothiazine (5 mM) contained in an upturned vial pressed into the surface of the gum. A control sample contained no enzyme mediator compound. After standing at room temperature for 1 day, the vials were removed. For the sample treated in the presence of 10-H-phenothiazine, the treated portion of the gum was found to be harder and more brittle than the surrounding untreated gum, and could be easily dislodged from the surface of the concrete slab with the tip of a metal spatula, leaving no residue behind. The surrounding untreated portions of the gum remained firmly adhered the surface of the slab. The control sample, by contrast, showed some degree of swelling and increased fluidity as in Example 4. However, it was necessary to use water pressure to detach the treated portion of the residue from the slab.

Example 18

Compatibility of enzymes with ionic liquid compositions was determined by high throughput screening on multiple well plates of various enzymes against various concentrations of ionic liquids in water. The oxidation of catechol to 1,2-benzoquinone was measured in aqueous sodium phosphate-citrate buffer solutions (25 mM) containing laccase (25 $mgL^{-1}$) and an ionic liquid, premixed at pH 6.0 for laccase from *Agaricus bisporus* (LAB) and at pH 4.5 for laccase from *Trametes versicolor* (LTV). The pH was verified by diluting the final reaction mixture in deionised water and measuring the pH using a pH meter. The rate of 1,2-benzoquinone formation was measured using an Agilent spectrophotometer at 405 nm and 22° C. using an extinction coefficient of 760 $M^{-1}$ $cm^{-1}$. The activity was measured over a range of ionic liquid concentrations from 0 to 99.4%, since the laccases were not soluble in the pure ionic liquids, but could be dissolved when the ionic liquids were mixed with 0.6% of buffer solution containing the enzyme.

Representative concentrations of ionic liquids in water in which laccase was found to be stable using this method are shown in Table 2.

TABLE 2

| Ionic liquid cation | Ionic liquid anion | Concentration of ionic liquid in water that inactivates Laccase (LTV) |
|---|---|---|
| $[N_{2,1,1,2OH}]^+$ | $[EtOSO_3]^-$ | 30% |
| $[N_{1,1,1,3OH}]^+$ | $[EtOSO_3]^-$ | 30% |
| $[N_{4,2,1,1}]^+$ | $[EtOSO_3]^-$ | 70% |
| $[emim]^+$ | $[EtOSO_3]^-$ | 30% |
| $[N_{8,4,1,1}]^+$ | $[NO_3]^-$ | 90% |
| $[bmim]^+$ | $[docusate]^-$ | 90% |
| $[emim]^+$ | $[docusate]^-$ | 90% |
| $[bmpyr]^+$ | $[docusate]^-$ | 90% |
| $[bmim]^+$ | $[CH_3CH(OH)CO_2]^-$ | 90% |

The present invention may also be defined by way of the following numbered clauses:

1. A method of modifying a chewing gum residue so as to ease removal of the chewing gum residue from a substrate, the method comprising applying to the residue a chewing gum modifying composition comprising an ionic liquid having the formula:

$$[Cat]^+[X]^-$$

wherein: $[Cat]^+$ is a cationic species, and $[X]^-$ is an anionic species.

2. A method according to Clause 1, wherein $[Cat]^+$ is a cationic species selected from the group consisting of: ammonium, azaannulenium, azathiazolium, benzofuranium, borolium, diazabicyclodecenium, diazabicyclononenium, diazabicycloundecenium, dithiazolium, furanium, imidazolium, indolinium, indolium, morpholinium, oxaborolium, oxaphospholium, oxazinium, oxazolium, iso-oxazolium, oxathiazolium, pentazolium, phospholium, phosphonium, phthalazinium, piperazinium, piperidinium, pyranium, pyrazinium, pyrazolium, pyridazinium, pyridinium, pyrimidinium, pyrrolidinium, pyrrolium, quinazolinium, quinolinium, iso-quinolinium, quinoxalinium, selenazolium, tetrazolium, iso-thiadiazolium, thiazinium, thiazolium, thiophenium, triazadecenium, triazolium, and iso-triazolium.

3. A method according to Clause 2, wherein $[Cat]^+$ is a cationic species selected from the group consisting of:

$$[N(R^a)(R^b)(R^c)(R^d)]^+ \text{ and } [P(R^a)(R^b)(R^c)(R^d)]^+$$

wherein $R^a$, $R^b$, $R^c$, and $R^d$ are each independently selected from a $C_1$ to $C_{15}$ straight chain or branched alkyl group, a $C_3$ to $C_8$ cycloalkyl group, or a $C_6$ to $C_{10}$ aryl group, wherein said alkyl, cycloalkyl or aryl groups are unsubstituted or may be substituted by one to three groups selected from: $C_1$ to $C_6$ alkoxy, $C_2$ to $C_{12}$ alkoxyalkoxy, $C_6$ to $C_{10}$ aryl, $C_2$ to $C_{15}$ straight chain or branched alkenyl, —CN, —OH, —$NO_2$, —$CO_2$($C_1$ to $C_6$)alkyl, —OC(O)($C_1$ to $C_6$)alkyl, $C_7$ to $C_{30}$ aralkyl and $C_7$ to $C_{30}$ alkaryl, and wherein $R^b$ may also be hydrogen.

4. A method according to Clause 3, wherein $R^a$, $R^b$, $R^c$, and $R^d$ are each independently selected from a $C_1$ to $C_{15}$ straight chain or branched alkyl group, a $C_3$ to $C_8$ cycloalkyl group, or a $C_6$ to $C_{10}$ aryl group, wherein said alkyl, cycloalkyl or aryl groups are unsubstituted or may be substituted by one to three groups selected from: $C_1$ to $C_6$ alkoxy, $C_2$ to $C_{12}$ alkoxyalkoxy, $C_6$ to $C_{10}$ aryl, —CN, —OH, —$NO_2$, —$CO_2$($C_1$ to $C_6$)alkyl, —OC(O)($C_1$ to $C_6$)alkyl, $C_7$ to $C_{30}$ aralkyl and $C_7$ to $C_{30}$ alkaryl, and wherein $R^b$ may also be hydrogen.

5. A method according to Clause 4 wherein $[Cat]^+$ is a cationic species having the formula:

$$[N(R^a)(R^b)(R^c)(R^d)]^+$$

wherein $R^a$, $R^b$, $R^c$ and $R^d$ are each independently selected from a $C_1$ to $C_8$, straight chain or branched alkyl group, a $C_3$ to $C_6$ cycloalkyl group, or a $C_6$ aryl group, wherein said alkyl, cycloalkyl or aryl groups are unsubstituted or may be substituted by one to three groups selected from: $C_1$ to $C_6$ alkoxy, $C_2$ to $C_{12}$ alkoxyalkoxy, $C_6$ to $C_{10}$ aryl, —CN, —OH, —$NO_2$, —$CO_2$($C_1$ to $C_6$)alkyl, —OC(O)($C_1$ to $C_6$)alkyl, $C_7$ to $C_{10}$ aralkyl and $C_7$ to $C_{10}$ alkaryl, and wherein $R^b$ may also be hydrogen.

6. A method according to Clause 5, wherein $[Cat]^+$ is a cationic species selected from the group consisting of:

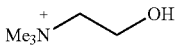

([$N_{1,1,1,2OH}$])

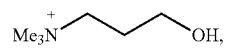

([$N_{1,1,1,3OH}$])

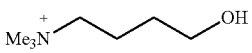

([$N_{1,1,1,4OH}$])

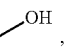

([$N_{2,2,2,1}$])

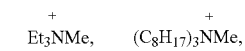

([$N_{8,8,8,1}$])

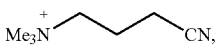

([$N_{1,1,1,3CN}$])

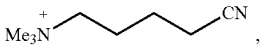

([$N_{1,1,1,4CN}$])

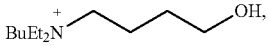

([$N_{4,2,2,4OH}$])

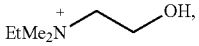

([$N_{2,1,1,2OH}$])

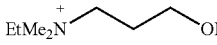

([$N_{2,1,1,3OH}$])

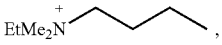

([$N_{4,2,1,1}$])

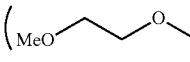

([$N_{H,(2O2O1)x3}$])

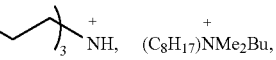

([$N_{8,4,1,1}$])

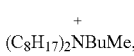

([$N_{8,8,4,1}$])

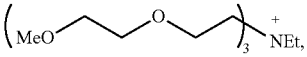

([$N_{2,(2O2O1)\ x\ 3}$])

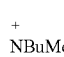

and

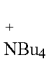

([$N_{4,1,1,1}$]) ([N4,4,4,4])

7. A method according to Clause 6, wherein $[Cat]^+$ is a cationic species selected from the group consisting of:

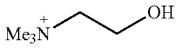

([$N_{1,1,1,2OH}$])

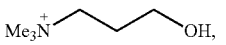

([$N_{1,1,1,3OH}$])

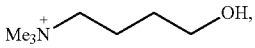

([$N_{1,1,1,4OH}$])

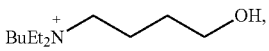

([$N_{4,2,2,4OH}$])

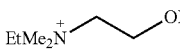

and ([$N_{2,1,1,2OH}$])

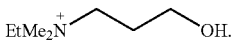

([$N_{2,1,1,3OH}$])

8. A method according to Clause 7, wherein $[Cat]^+$ is a cationic species having the formula:

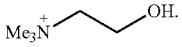

([$N_{2,1,1,2OH}$])

9. A method according to Clause 2, wherein $[Cat]^+$ is a cationic species selected from the group consisting of:

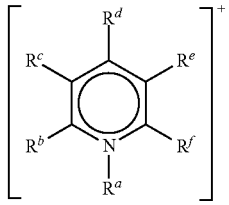

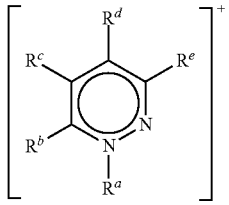

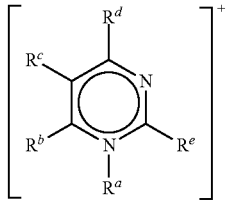

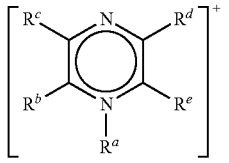

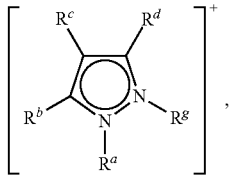

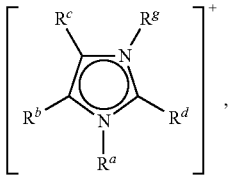

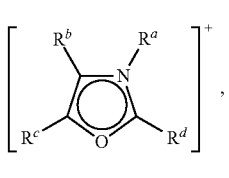

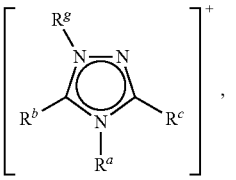

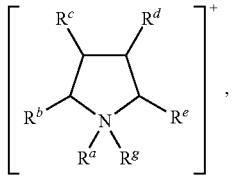

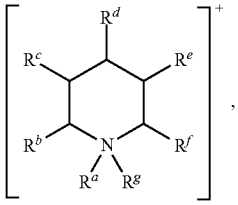

and

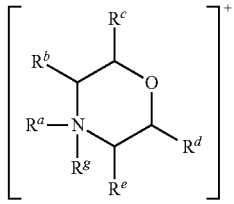

wherein: $R^a$, $R^b$, $R^c$, $R^d$, $R^e$, $R^f$, $R^g$ and $R^h$ are each independently selected from hydrogen, a $C_1$ to $C_{20}$ straight chain or branched alkyl group, a $C_3$ to $C_8$ cycloalkyl group, or a $C_6$ to $C_{10}$ aryl group, or any two of $R^b$, $R^c$, $R^d$, $R^e$ and $R^f$ attached to adjacent carbon atoms may form a methylene chain —$(CH_2)_q$— wherein q is from 3 to 6, and wherein said alkyl, cycloalkyl or aryl groups, or said methylene chain, are unsubstituted or may be substituted by one to three groups selected from: $C_1$ to $C_6$ alkoxy, $C_2$ to $C_{12}$ alkoxyalkoxy, $C_6$ to $C_{10}$ aryl, $C_2$ to $C_{15}$ straight chain or branched alkenyl, —CN, —OH, —$NO_2$, $C_7$ to $C_{10}$ aralkyl and $C_7$ to $C_{10}$ alkaryl, —$CO_2$($C_1$ to $C_6$)alkyl, —OC(O)($C_1$ to $C_6$)alkyl.

10. A method according to Clause 9, wherein $R^a$, $R^b$, $R^c$, $R^d$, $R^e$, $R^f$, $R^g$ and $R^h$ are each independently selected from hydrogen, a $C_1$ to $C_{20}$ straight chain or branched alkyl group, a $C_3$ to $C_8$ cycloalkyl group, or a $C_6$ to $C_{10}$ aryl group, or any two of $R^b$, $R^c$, $R^d$, $R^e$ and $R^f$ attached to adjacent carbon atoms may form a methylene chain —$(CH_2)_q$— wherein q is from 3 to 6, and wherein said alkyl, cycloalkyl or aryl groups, or said methylene chain, are unsubstituted or may be substituted by one to three groups selected from: $C_1$ to $C_6$ alkoxy, $C_2$ to $C_{12}$ alkoxyalkoxy, $C_6$ to $C_{10}$ aryl, —CN, —OH, —$NO_2$, $C_7$ to $C_{10}$ aralkyl and $C_7$ to $C_{10}$ alkaryl, —$CO_2$($C_1$ to $C_6$)alkyl, —OC(O)($C_1$ to $C_6$)alkyl.

11. A method according to Clause 9 or Clause 10, wherein $[Cat]^+$ is a cationic species selected from the group consisting of:

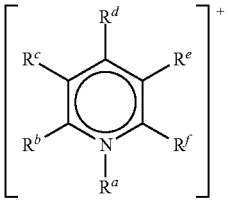

and

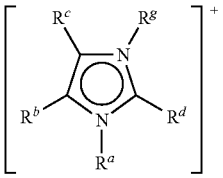

wherein $R^a$, $R^b$, $R^c$, $R^d$, $R^e$, $R^f$ and $R^g$ are as defined in Clause 9 or Clause 10.

12. A method according to Clause 11 wherein $[Cat]^+$ is a cationic species having the formula:

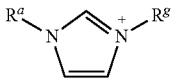

wherein $R^a$ and $R^g$ are as a defined in Clause 9 or Clause 10.

13. A method according to Clause 12 wherein $[Cat]^+$ is a cationic species having the formula:

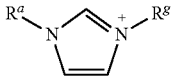

wherein $R^a$ and $R^g$ are each independently selected from a $C_1$ to $C_8$, straight chain or branched alkyl group, a $C_3$ to $C_6$ cycloalkyl group, or a $C_6$ aryl group, wherein said alkyl, cycloalkyl or aryl groups are unsubstituted or may be substituted by one to three groups selected from: $C_1$ to $C_6$ alkoxy, $C_2$ to $C_{12}$ alkoxyalkoxy, $C_6$ to $C_{10}$ aryl, —CN, —OH, —$NO_2$, —$CO_2$($C_1$ to $C_6$)alkyl, —OC(O)($C_1$ to $C_6$)alkyl, $C_7$ to $C_{10}$ aralkyl and $C_7$ to $C_{10}$ alkaryl.

14. A method according to Clause 12 or Clause 13, wherein $[Cat]^+$ is a cationic species selected from the group consisting of:

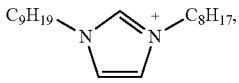

[$C_8C_9$im]

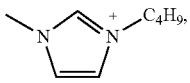

[bmim]

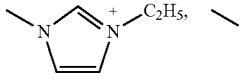

[emim]

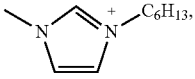

[hmim]

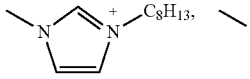

[$C_8$mim]

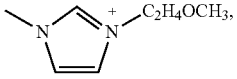

[$MeOC_2$mim]

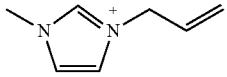

, and

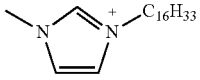

,

[(allyl)mim] [$C_{16}$mim]

15. A method according to Clause 14, wherein $[Cat]^+$ is a cationic species selected from the group consisting of:

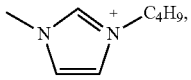

[bmim]

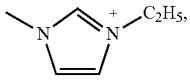

[emim]

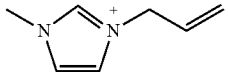

, and

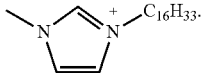

.

[(allyl)mim] [$C_{16}$mim]

16. A method according to Clause 11 wherein $[Cat]^+$ is a cationic species having the formula:

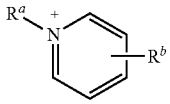

wherein $R^a$ and $R^b$ are each independently selected from a $C_1$ to $C_8$, straight chain or branched alkyl group, a $C_3$ to $C_6$ cycloalkyl group, or a $C_6$ aryl group, wherein said alkyl, cycloalkyl or aryl groups are unsubstituted or may be substituted by one to three groups selected from: $C_1$ to $C_6$ alkoxy, $C_2$ to $C_{12}$ alkoxyalkoxy, $C_6$ to $C_{10}$ aryl, —CN, —OH, —$NO_2$, —$CO_2$($C_1$ to $C_6$)alkyl, —OC(O)($C_1$ to $C_6$)alkyl, $C_7$ to $C_{10}$ aralkyl and $C_7$ to $C_{10}$ alkaryl, and wherein $R^b$ may also be hydrogen.

17. A method according to Clause 16 wherein $[Cat]^+$ is:

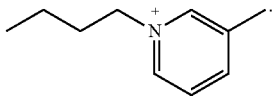

[bmpyr]

18. A method according to any of the preceding clauses, wherein $[X]^-$ is an anionic species selected from the group consisting of: $[F]^-$, $[Cl]^-$, $[Br]^-$, $[I]^-$, $[NO_3]^-$, $[NO_2]^-$, $[BF_4]^-$, $[PF_6]^-$, $[SbF_6]^-$, $[SCN]^-$, $[H_2PO_4]^-$, $[HPO_4]^{2-}$, $[PO_4]^{3-}$, $[HSO_4]^-$, $[SO_4]^{2-}$, $[CH_3SO_3]^-$, $[C_2H_5SO_3]^-$, $[C_8H_{17}SO_3]^-$, $[CH_3(C_6H_4)SO_3]^-$, [docusate]$^-$, $[CH_3OSO_3]^-$, $[C_2H_5OSO_3]^-$, $[C_8H_{17}OSO_3]^-$, $[H_3C(OCH_2CH_2)_nOSO_3]^-$ wherein n is an integer from 1 to 10, $[CF_3CO_2]^-$, $[(CF_3SO_2)_3C]^-$, $[(CF_3SO_2)_2N]^-$, $[CF_3SO_3]^-$, $[(CF_3)_2N]^-$, $[(C_2F_5)_3PF_3]^-$, $[(C_3F_7)_3PF_3]^-$, $[(C_2F_5)_2P(O)O]^-$, $[(CH_3)_2PO_4]^-$, $[(CH_3)_2P(O)O]^-$, $[\{(CH_3)_3CCH_2CH(CH_3)CH_2\}_2P(O)O]^-$, $[HCO_2]^-$, $[CH_3CO_2]^-$, $[CH_3CH_2CO_2]^-$, $[CH_2(OH)CO_2]^-$, $[CH_3CH(OH)CO_2]^-$, $[HCO_3]^-$, $[CO_3]^{2-}$, $[CH_3OCO_2]^-$, $[C_2H_5OCO_2]^-$, $[(CN)_2N]^-$, [saccharin]$^-$, and [linoleate]$^-$.

19. A method according to Clause 18, wherein $[X]^-$ is an anionic species selected from the group consisting of:

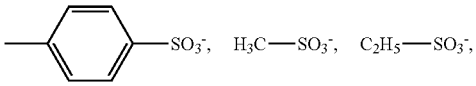

$SO_3^-$, $H_3C—SO_3^-$, $C_2H_5—SO_3^-$, $C_8H_{17}—SO_3^-$, $H_3C—OSO_3^-$, $C_2H_5—OSO_3^-$, $C_8H_{17}—OSO_3^-$, $HCO_2^-$, $CH_3CO_2^-$, $CH_3CH_2CO_2^-$, $CH_3CH(OH)CO_2^-$, $CH_3OCO_2^-$, $CH_3CH_2OCO_2^-$, $(CN)_2N^-$, $Cl^-$, $NO_3^-$, $(CF_2SO_2)_2N^-$,

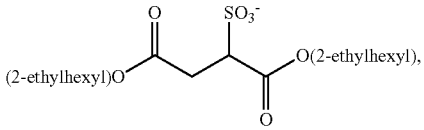

(docusate)

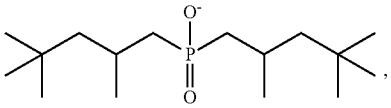

,

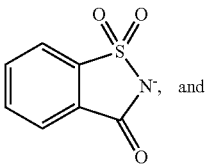

, and

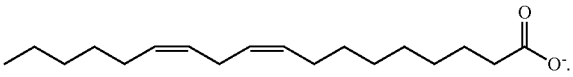

.

20. A method according to Clause 19, wherein $[X]^-$ is an anionic species selected from the group consisting of:

$H_3C—OSO_3^-$, $C_2H_5—OSO_3^-$, $C_8H_{17}—OSO_3^-$, $CH_3CO_2^-$, $CH_3CH_2CO_2^-$, $CH_3CH(OH)CO_2^-$, $Cl^-$, $NO_3^-$, $(CF_3SO_2)_2N^-$, and

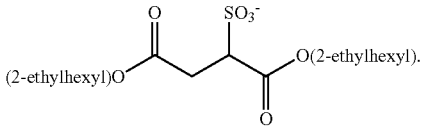

(docusate)

21. A method according to Clause 20, wherein $[X]^-$ is an anionic species selected from:

$Cl^-$, $(CF_3SO_2)_2N^-$, and

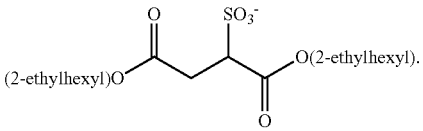

(docusate)

22. A method according to Clause 21, wherein $[X]^-$ is:

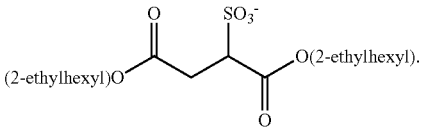

(docusate)

23. A method according to Clause 18 wherein the anion is selected from the group consisting of: $[F]^-$, $[Cl]^-$, $[Br]^-$, $[I]^-$, $[HCO_3]^-$, $[CO_3]^{2-}$, $[HSO_4]^-$, $[SO_4]^{2-}$, $[H_2PO_4]^-$, $[HPO_4]^{2-}$, $[PO_4]^{3-}$ and $[NO_3]^-$.

24. A method according to any of the preceding clauses, wherein the ionic liquid has a melting point below 100° C.

25. A method according to Clause 24, wherein the ionic liquid has a melting point below 40° C.

26. A method according to any of the preceding clauses, wherein the chewing gum modifying composition further comprises one or more oxidising reagents.

27. A method according to Clause 26, wherein the oxidising reagents comprise an oxidation catalyst and an oxygen source.

28. A method according to Clause 27, wherein the oxidation catalyst is a lanthanide salt or a transition metal salt.

29. A method according to Clause 28, wherein the oxidation catalyst is a Fe(II), Fe(III), Mn(VII), Mn(VI), Mo(VI), Co(II), Zr(IV), Ce(IV), or Ni(II) salt.

30. A method according to Clause 29, wherein the oxidation catalyst is a Fe(II) or Fe(III) salt.

31. A method according to Clause 30, wherein the oxidation catalyst is a Fe(II) or Fe(III) chloride or sulphate salt.

32. A method according to any of Clauses 27 to 31, wherein the oxygen source is selected from hydrogen peroxide, a hydrogen peroxide releasing compound, a salt having a halogen oxyanion, an organic hydroperoxide, an organic peroxyacid, or an organic peroxyacid salt.

33. A method according to Clause 32, wherein the oxygen source is selected from hydrogen peroxide, sodium perborate, sodium percarbonate, sodium persulphate, sodium perphosphate, potassium perborate, potassium percarbonate, potassium persulphate, potassium perphosphate, urea peroxide, sodium hypochlorite, sodium chlorite, sodium chlorate, sodium perchlorate, sodium bromate, sodium perbromate, sodium iodate, sodium periodate, potassium hypochlorite, potassium chlorite, potassium chlorate, potassium perchlorate, potassium bromate, potassium perbromate, potassium iodate, potassium periodate, tert-butylhydroperoxide, peracetic acid, and sodium peracetate.

34. A method according to Clause 33, wherein the oxygen source is selected from hydrogen peroxide, sodium perborate, sodium percarbonate, sodium persulphate, and sodium perphosphate.

35. A method of modifying a chewing gum residue so as to ease removal of the chewing gum residue from a substrate, the method comprising applying to the residue a chewing gum modifying composition comprising:

(i) an ionic liquid as defined in any of Clauses 1 to 25; and (ii) one or more oxidising reagents as defined in any of Clauses 26 to 34.

36. A method according to any of Clauses 1 to 25, wherein the chewing gum modifying composition further comprises:

(i) one or more natural or modified enzymes selected from the group consisting of laccases, peroxidases, ligninases and lipoxygenases; and (ii) one or more enzyme mediator compounds.

37. A method according to Clause 36, wherein the enzyme is selected from the group consisting of laccases and lipoxygenases.

38. A method according to Clause 37, wherein the enzyme is selected from laccases.

39. A method according to Clause 38, wherein the enzyme is selected from the group consisting of laccase from *Trametes versicolor* and laccase from *Agaricus bisporus*.

40. A method according to any of Clauses 36 to 39, wherein the one or more enzyme mediator compounds are selected from the group consisting of:

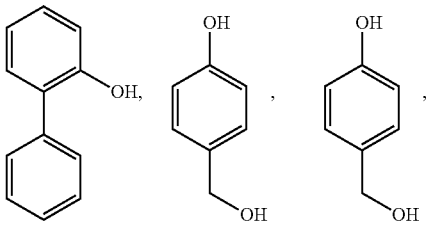

2-hydroxybiphenyl 4-hydroxybenzyl alcohol 4-methoxybenzyl alcohol

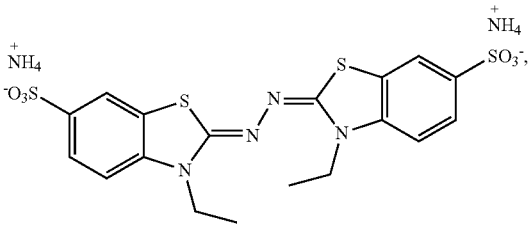

2,2′-azine-bis(3-ethylbenzothiazoline-6-sulfonic acid) (ABTS)

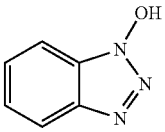

1-hydroxybenzotriazole

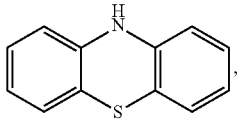

10-H-phenothazine

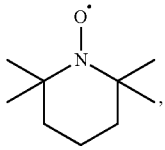

2,2,6,6-tetramethyl-1-piperadinyloxyl (TEMPO)

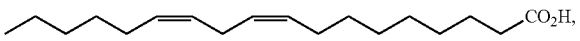

Linoleic acid

-continued

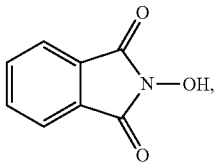

N-hydroxyphthaleimide

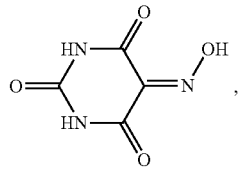

violuric acid

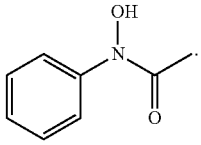

N-hydroxyacetanilide

41. A method according to Clause 40 wherein the one or more enzyme mediator compounds are selected from the group consisting of:

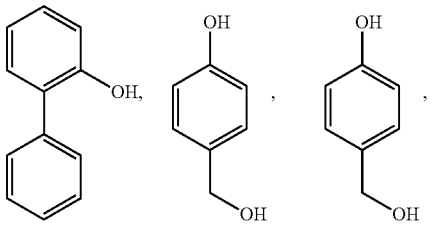

2-hydroxybiphenyl 4-hydroxybenzyl alcohol 4-methoxybenzyl alcohol

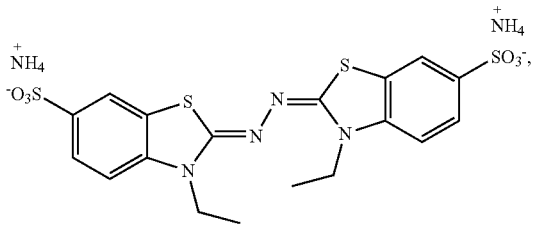

2,2′-azine-bis(3-ethylbenzothiazoline-6-sulfonic acid) (ABTS)

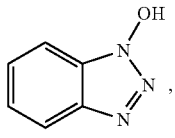

1-hydroxybenzotriazole

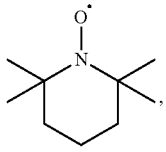

2,2,6,6-tetramethyl-1-piperadinyloxyl (TEMPO)

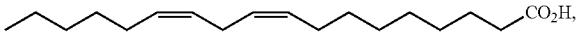

Linoleic acid

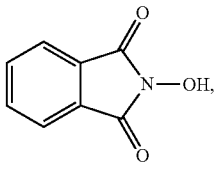

N-hydroxyphthaleimide

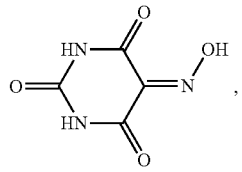

violuric acid

-continued

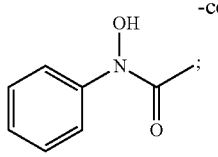

N-hydroxyacetanilide so as to obtain a modified chewing gum residue that is more fluid than the starting chewing gum residue.

42. A method according to Clause 41 wherein the modified chewing gum residue exhibits a lower molecular weight distribution compared to the starting chewing gum residue.

43. A method according to Clause 40 wherein the enzyme mediator compound is:

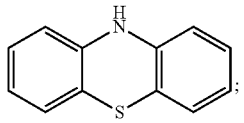

so as to obtain a modified chewing gum residue that is more rigid than the starting chewing gum residue.

44. A method according to Clause 43 wherein the modified chewing gum residue comprises compounds of increased molecular weight compared to the starting chewing gum residue.

45. A method according to any of Clauses 36 to 44, wherein the chewing gum modifying composition further comprises one or more enzymes selected from lipases and esterases.

46. A method according to any of the preceding clauses, wherein the chewing gum modifying composition further comprises a co-solvent.

47. A method according to Clause 46, wherein the co-solvent is water.

48. A method according to Clause 46 or Clause 47, wherein the ionic liquid and the co-solvent are present in the chewing gum modifying composition in a weight ratio of from 5:95 to 99:1.

49. A method according to any of Clauses 36 to 45, wherein the chewing gum modifying composition comprises ionic liquid and water in a weight ratio of from 10:90 to 90:10.

50. A method according to any of the preceding clauses, wherein the chewing gum modifying composition further comprises one or more additives selected from the group consisting of surfactants, viscosity modifiers, emulsifiers, melting point suppressants and wetting agents.

51. A method according to any of the preceding clauses, wherein the chewing gum residue is derived from a chewing gum comprising between 10 and 75% by weight of a gum base, wherein the gum base comprises between 5 and 80% by weight of one or more elastomers.

52. A method according to Clause 51, wherein the gum base is derived from chicle, jelutong, sorva, gutta percha, gutta hang kang, niger gutta, gutta kataiu, chilte, chiquibul, massaranduba balata, massaranduba chocolate, nispero, leche, caspi and rosidinha.

53. A method according to Clause 51, wherein the gum base comprises synthetic elastomers selected from polyisoprene, polybutadiene, styrene-butadiene copolymers, polyisobutylene, polyvinylacetate, polyethylene, isobutylene-isoprene copolymer, vinyl acetate-vinyl laurate copolymer, crosslinked polyvinyl pyrrolidone, polymethylmethacrylate; copolymers of lactic acid, polyhydroxyalkanoates, plasticized ethylcellulose, polyvinyl acetatephthalate; and combinations thereof.

54. A method according to any of Clauses 51 to 53, wherein the gum base comprises up to 50% by weight of one or more plasticizers, up to 20% by weight of one or more softeners and up to 10% by weight of one or more waxes.

55. A method according to any of the preceding clauses, wherein the substrate comprises stone, concrete, cement, bricks, gypsum, plasterboard, clay, ceramic, glass, asphalt, tarmac, bitumen, metals, wood, varnish, lacquer or a textile.

56. A method according to any of the preceding clauses, where the modified residue is subsequently removed from the substrate by sweeping, scrubbing, vacuuming, or hosing with low pressure water.

57. A kit of parts for use in a method of removing chewing gum residues from substrates, the kit comprising:

(i) a first part comprising an ionic liquid as defined in any of Clauses 1 to 25;

(ii) a second part comprising an oxidation catalyst as defined in any of Clauses 27 to 31, the second part being optionally combined with the first part; and (iii) an oxygen source as defined in any of Clauses 27 and 32 to 34 as a third part.

58. A kit of parts for use in a method of removing chewing gum residues from substrates, the kit comprising:

(i) a first part comprising an ionic liquid as defined in any of Clauses 1 to 25;

(ii) a second part comprising one or more natural or modified enzymes selected from the group consisting of: laccases, peroxidases, lignases and lipoxygenases;

(iii) a third part comprising one or more enzyme mediator compounds, the third part being optionally combined with the first part or the second part.

59. A composition comprising:

(i) an ionic liquid having the formula $[Cat]^+[X]^-$ in wherein $[X]^-$ is an anionic species as defined in any of Clauses 18 to 23 and $[Cat]^+$ has the formula:

$$[N(R^a)(R^b)(R^c)(R^d)]^+ \text{ or } [P(R^a)(R^b)(R^c)(R^d)]^+$$

wherein $R^a$, $R^b$, $R^c$, and $R^d$ are each independently selected from a $C_1$ to $C_{15}$ straight chain or branched alkyl group, a $C_3$ to $C_8$ cycloalkyl group, or a $C_6$ to $C_{10}$ aryl group, wherein said alkyl, cycloalkyl or aryl groups are unsubstituted or may be substituted by one to three groups selected from: $C_1$ to $C_6$ alkoxy, $C_2$ to $C_{12}$ alkoxyalkoxy, $C_6$ to $C_{10}$ aryl, $C_2$ to $C_{15}$ straight chain or branched alkenyl, —CN, —OH, —$NO_2$, —$CO_2$($C_1$ to $C_6$)alkyl, —OC(O)($C_1$ to $C_6$)alkyl, $C_7$ to $C_{30}$ aralkyl and $C_7$ to $C_{30}$ alkaryl, and wherein $R^b$ may also be hydrogen.

(ii) one or more natural or modified enzymes selected from the group consisting of: laccases, peroxidases, lipoxygenases and lipases.

60. A composition according to Clause 59 wherein $[Cat]^+$ is selected from:

$$[N(R^a)(R^b)(R^c)(R^d)]^+ \text{ or } [P(R^a)(R^b)(R^c)(R^d)]^+$$

wherein $R^a$, $R^b$, $R^c$, and $R^d$ are each independently selected from a $C_1$ to $C_{15}$ straight chain or branched alkyl group, a $C_3$ to $C_8$ cycloalkyl group, or a $C_6$ to $C_{10}$ aryl group, wherein said alkyl, cycloalkyl or aryl groups are unsubstituted or may be substituted by one to three groups selected from: $C_1$ to $C_6$ alkoxy, $C_2$ to $C_{12}$ alkoxyalkoxy, $C_6$ to $C_{10}$ aryl, —CN, —OH, —$NO_2$, —$CO_2$($C_1$ to $C_6$)alkyl, —OC(O)($C_1$ to $C_6$)alkyl, $C_7$ to $C_{30}$ aralkyl and $C_7$ to $C_{30}$ alkaryl, and wherein $R^b$ may also be hydrogen.

61. A composition according to Clause 60 wherein $[Cat]^+$ is selected from:

$$[N(R^a)(R^b)(R^c)(R^d)]^+$$

wherein $R^a$, $R^b$, $R^g$, $R^d$ and $R^g$ are each independently selected from a $C_1$ to $C_8$, straight chain or branched alkyl group, a $C_3$ to $C_6$ cycloalkyl group, or a $C_6$ aryl group, wherein said alkyl, cycloalkyl or aryl groups are unsubstituted or may be substituted by one to three groups selected from: $C_1$ to $C_6$ alkoxy, $C_2$ to $C_{12}$ alkoxyalkoxy, $C_6$ to $C_{10}$ aryl, —CN, —OH, —$NO_2$, —$CO_2$($C_1$ to $C_6$)alkyl, —OC(O)($C_1$ to $C_6$)alkyl, $C_7$ to $C_{10}$ aralkyl and $C_7$ to $C_{10}$ alkaryl, and wherein $R^b$ may also be hydrogen.

62. A composition according to Clause 61 wherein $[Cat]^+$ is selected from the group consisting of:

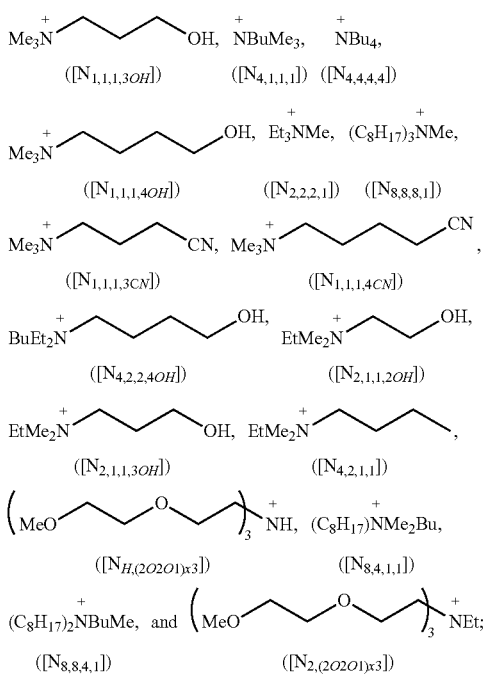

63. A composition comprising:

(i) an ionic liquid having the formula $[Cat]^+[X]^-$ in wherein $[Cat]^+$ is a cationic species as defined in any of Clauses 1 to 17 and $[X]^-$ is selected from the group consisting of: $[F]^-$, $[Cl]^-$, $[I]^-$, $[NO_3]^-$, $[NO_2]^-$, $[SbF_6]^-$, $[SCN]^-$, $[H_2PO_4]^-$, $[HPO_4]^{2-}$, $[PO_4]^{3-}$ $[HSO_4]^-$, $[SO_4]^{2-}$, $[CH_3SO_3]^-$, $[C_2H_5SO_3]^-$, $[C_8H_{17}SO_3]^-$, $[CH_3(C_6H_4)SO_3]^-$, [docusate]$^-$, $[C_8H_{17}OSO_3]^-$, wherein n is an integer from 1 to 10, $[CF_3CO_2]^-$, $[(CF_3SO_2)_3C]^-$, $[(CF_3SO_2)_2N]^-$, $[CF_3SO_3]^-$, $[(CF_3)_2N]^-$, $[(C_2F_5)_3PF_3]^-$, $[(C_3F_7)_3PF_3]^-$, $[(C_2F_5)_2P(O)O]^-$, $[(CH_3)_2PO_4]^-$, $[(CH_3)_2P(O)O]^-$, $[\{(CH_3)_3CCH_2CH(CH_3)CH_2\}_2P(O)O]^-$, $[HCO_2]^-$, $[CH_3CO_2]^-$, $[CH_3CH_2CO_2]^-$, $[CH_2(OH)CO_2]^-$, $[CH_3CH(OH)CO_2]^-$, $[HCO_3]^-$, $[CO_3]^{2-}$, $[CH_3OCO_2]^-$, $[C_2H_5OCO_2]^-$, [saccharin]$^-$, and [linoleate]$^-$; and (ii) one or more natural or modified enzymes selected from the group consisting of: laccases, peroxidases, lipoxygenases and ligninases.

64. A composition according to Clause 63, wherein $[X]^-$ is [docusate]$^-$.

65. A composition according to any of Clauses 59 to 64, wherein the enzyme is selected from the group consisting of: laccase from *Trametes versicolor*, laccase from *Agaricus bisporus*, horseradish peroxidase, manganese peroxidase from *Phanerochaete chrysosporium*, hydroquinone peroxidase from *Azotobacter beijerinckii*, and soybean lipoxygenase.

66. A composition according to any of Clauses 59 to 65 wherein the composition further comprises one or more enzyme mediator compounds selected from the group consisting of:

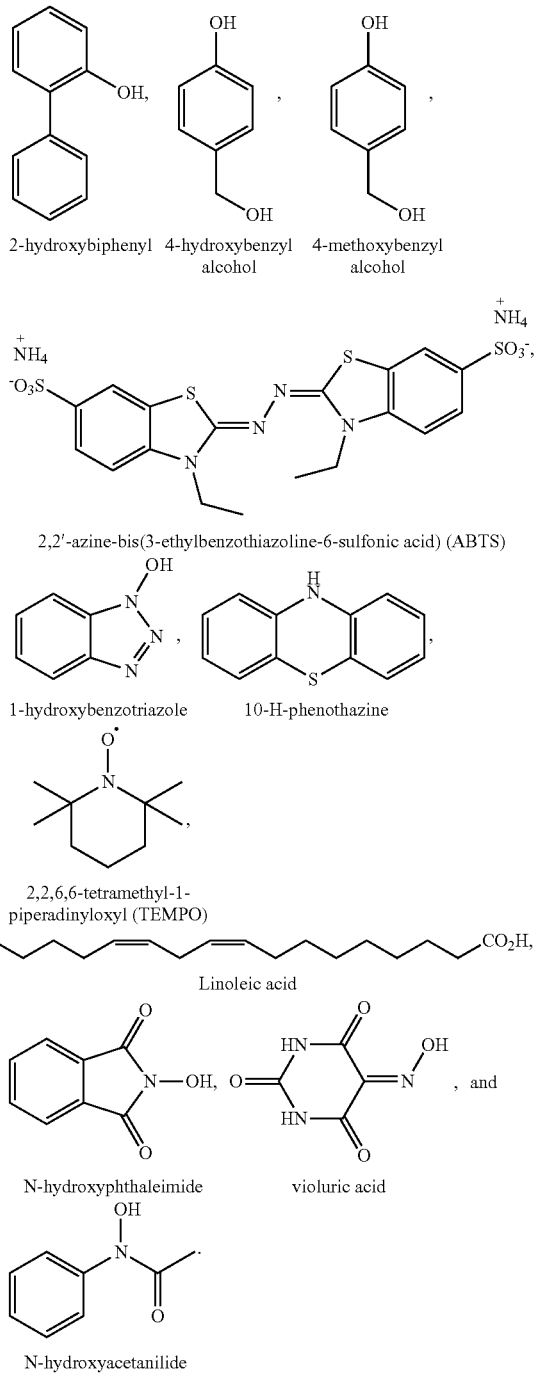

67. Use of a composition as described any of Clauses 1 to 50 and 59 to 66 for removing chewing gum residues from substrates.

68. Use of an ionic liquid as defined in any of Clauses 1 to 25 for the removal of chewing gum residues from substrates.

The invention claimed is:

1. A method of modifying a chewing gum residue so as to ease removal of the chewing gum residue from a substrate, the method comprising applying to the residue a chewing gum modifying composition comprising an ionic liquid having the formula:

$$[Cat]^+[X]^-$$

wherein: $[Cat]^+$ is a cationic species, and $[X]^-$ is an anionic species.

2. A method according to claim 1, wherein $[Cat]^+$ is a cationic species selected from the group consisting of: ammonium, azaannulenium, azathiazolium, benzofuranium, borolium, diazabicyclodecenium, diazabicyclononenium, diazabicycloundecenium, dithiazolium, furanium, imidazolium, indolinium, indolium, morpholinium, oxaborolium, oxaphospholium, oxazinium, oxazolium, iso-oxazolium, oxathiazolium, pentazolium, phospholium, phosphonium, phthalazinium, piperazinium, piperidinium, pyranium, pyrazinium, pyrazolium, pyridazinium, pyridinium, pyrimidinium, pyrrolidinium, pyrrolium, quinazolinium, quinolinium, iso-quinolinium, quinoxalinium, selenazolium, tetrazolium, iso-thiadiazolium, thiazinium, thiazolium, thiophenium, triazadecenium, triazolium, and iso-triazolium.

3. A method according to claim 2, wherein $[Cat]^+$ is a cationic species selected from the group consisting of:

$$[N(R^a)(R^b)(R^c)(R^d)]^+ \text{ and } [P(R^a)(R^b)(R^c)(R^d)]^+$$

wherein $R^a$, $R^b$, $R^c$, and $R^d$ are each independently selected from a $C_1$ to $C_{15}$, straight chain or branched alkyl group, a $C_1$ to $C_{15}$, a $C_3$ to $C_8$ cycloalkyl group, or a $C_6$ to $C_{10}$ aryl group, wherein said alkyl, cycloalkyl or aryl groups are unsubstituted or may be substituted by one to three groups selected from: $C_1$ to $C_6$ alkoxy, $C_2$ to $C_{12}$ alkoxyalkoxy, $C_6$ to $C_{10}$ aryl, $C_2$ to $C_{15}$ straight chain or branched alkenyl, —CN, —OH, —$NO_2$, —$CO_2$($C_1$ to $C_6$)alkyl, —OC(O)($C_1$ to $C_6$)alkyl, $C_7$ to $C_{30}$ aralkyl and $C_7$ to $C_{30}$ alkaryl, and wherein $R^b$ may also be hydrogen.

4. A method according to claim 3, wherein $[Cat]^+$ is a cationic species selected from the group consisting of:

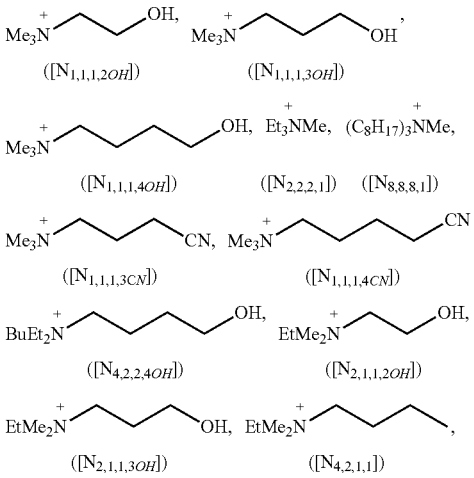

-continued

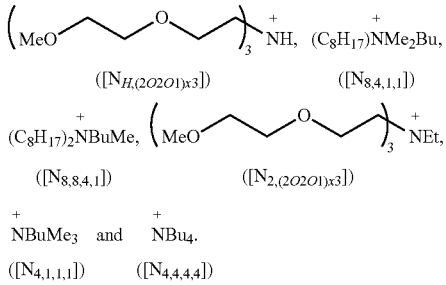

5. A method according to claim 2, wherein $[Cat]^+$ is a cationic species selected from the group consisting of:

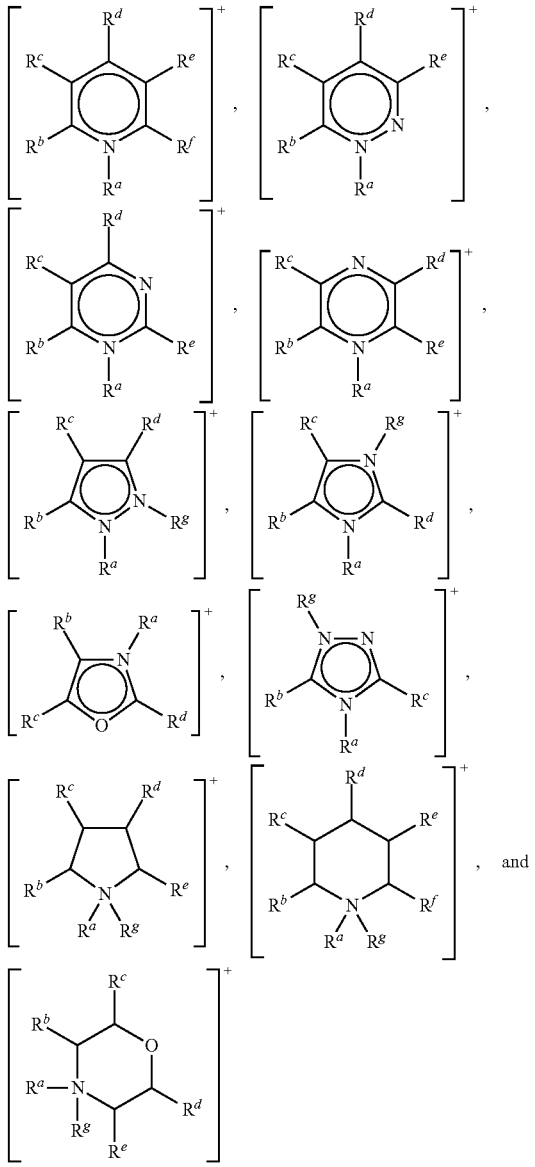

wherein: $R^a$, $R^b$, $R^c$, $R^d$, $R^e$, $R^f$, $R^g$ and $R^h$ are each independently selected from hydrogen, a $C_1$ to $C_{20}$ straight chain or branched alkyl group, a $C_3$ to $C_8$ cycloalkyl group, or a $C_6$ to $C_{10}$ aryl group, or any two of $R^b$, $R^c$, $R^d$, $R^e$ and $R^f$ attached to adjacent carbon atoms may form a methylene chain —$(CH_2)_q$— wherein q is from 3 to 6, and wherein said alkyl, cycloalkyl or aryl groups, or said methylene chain, are unsubstituted or may be substituted by one to three groups selected from: $C_1$ to $C_6$ alkoxy, $C_2$ to $C_{12}$ alkoxyalkoxy, $C_6$ to $C_{10}$ aryl, $C_2$ to $C_{15}$ straight chain or branched alkenyl, —CN, —OH, —$NO_2$, $C_7$ to $C_{10}$ aralkyl and $C_7$ to $C_{10}$ alkaryl, —$CO_2$ ($C_1$ to $C_6$)alkyl, —CO(O)($C_1$ to $C_6$)alkyl.

6. A method according to claim 5, wherein $[Cat]^+$ is a cationic species selected from the group consisting of:

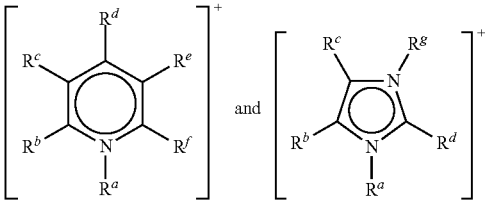

7. A method according to claim 1, wherein $[X]^-$ is an anionic species selected from the group consisting of: $[F]^-$, $[Cl]^-$, $[Br]^-$, $[I]^-$, $[NO_3]^-$, $[NO_2]^-$, $[BF_4]^-$, $[PF_6]^-$, $[SbF_6]^-$, $[SCN]^-$, $[H_2PO_4]^-$, $[HPO_4]^{2-}$, $[PO_4]^{3-}$, $[HSO_4]^-$, $[SO_4]^{2-}$, $[CH_3SO_3]^-$, $[C_2H_5SO_3]^-$, $[C_8H_{17}SO_3]^-$, $[CH_3(C_6H_4)SO_3]^-$, [docusate]$^-$, $[CH_3OSO_3]^-$, $[C_2H_5OSO_3]^-$, $[C_8H_{17}OSO_3]^-$, $[H_3C(OCH_2CH_2)_nOSO_3]^-$ wherein n is an integer from 1 to 10, $[CF_3CO_2]^-$, $[(CF_3SO_2)_3C]^-$, $[(CF_3SO_2)_2N]^-$, $[CF_3SO_3]^-$, $[(CF_3)_2N]^-$, $[(C_2F_5)_3PF_3]^-$, $[(C_3F_7)_3PF_3]^-$, $[(C_2F_5)_2P(O)O]^-$, $[(CH_3)_2PO_4]^-$, $[(CH_3)_2P(O)O]^-$, $[\{(CH_3)_3CCH_2CH(CH_3)CH_2\}_2P(O)O]^-$, $[HCO_2]^-$, $[CH_3CO_2]^-$, $[CH_3CH_2CO_2]^-$, $[CH_2(OH)CO_2]^-$, $[CH_3CH(OH)CO_2]^-$, $[HCO_3]^-$, $[CO_3]^{2-}$, $[CH_3OCO_2]^-$, $[C_2H_5OCO_2]^-$, $[(CN)_2N]^-$, [saccharin]$^-$, and [linoleate]$^-$.

8. A method according to claim 1, wherein the ionic liquid has a melting point below 100° C.

9. A method according to claim 1, wherein the chewing gum modifying composition further comprises one or more oxidizing reagents.

10. A method according to claim 9, wherein the oxidising reagents comprise an oxidation catalyst and an oxygen source.

11. A method according to claim 10, wherein the oxidation catalyst is a lanthanide salt or a transition metal salt.

12. A method according to claim 10, wherein the oxygen source is selected from hydrogen peroxide, a hydrogen peroxide releasing compound, a salt having a halogen oxyanion, an organic hydroperoxide, an organic peroxyacid, or an organic peroxyacid salt.

13. A method according to claim 1, wherein the chewing gum modifying composition further comprises:

(i) one or more natural or modified enzymes selected from the group consisting of laccases, peroxidases, ligninases and lipoxygenases; and (ii) one or more enzyme mediator compounds.

14. A method according to claim 13, wherein the one or more enzyme mediator compounds are selected from the group consisting of:

2-hydroxybiphenyl

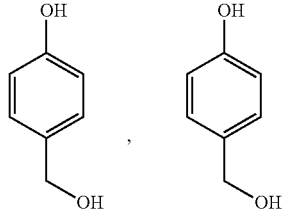

4-hydroxybenzyl alcohol 4-methoxybenzyl alcohol

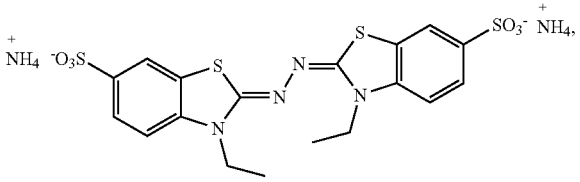

2,2′-azine-bis(3-ethylbenzothiazoline-6-sulfonic acid) (ABTS)

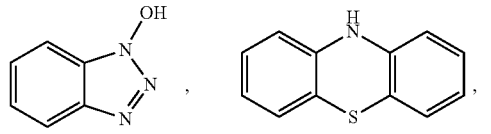

1-hydroxybenzotriazole

10-H-phenothazine

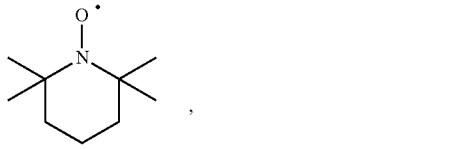

2,2,6,6-tetramethyl-1-piperadinyloxyl (TEMPO)

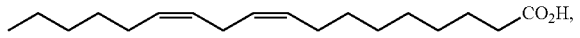

Linoleic acid

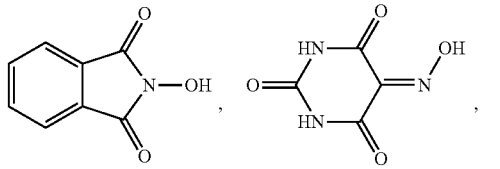

N-hydroxyphthaleimide violuric acid

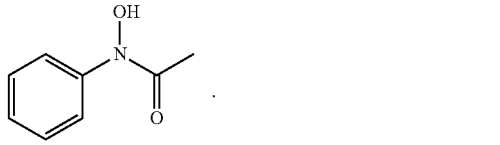

N-hydroxyacetanilide

15. A method according to claim 13, wherein the chewing gum modifying composition further comprises one or more enzymes selected from lipases and esterases.

16. A method according to claim 1, wherein the chewing gum modifying composition further comprises a co-solvent.

17. A method according to claim 16, wherein the co-solvent is water.

18. A method according to claim 16 wherein the ionic liquid and the co-solvent are present in the chewing gum modifying composition in a weight ratio of from 5:95 to 99:1.

19. A method according to claim 1, wherein the chewing gum modifying composition further comprises one or more additives selected from the group consisting of surfactants, viscosity modifiers, emulsifiers, melting point suppressants and wetting agents.

20. A method according to claim 1, wherein the chewing gum residue is derived from a chewing gum comprising between 10 and 75% by weight of a gum base, wherein the gum base comprises between 5 and 80% by weight of one or more elastomers.

21. A method according to claim 1, wherein the substrate comprises stone, concrete, cement, bricks, gypsum, plasterboard, clay, ceramic, glass, asphalt, tarmac, bitumen, metals, wood, varnish, lacquer or a textile.

22. A method according to claim 1, where the modified residue is subsequently removed from the substrate by sweeping, scrubbing, vacuuming, or hosing with low pressure water.

23. A kit of parts for use in a method of removing chewing gum residues from substrates, the kit comprising:

(i) a first part comprising an ionic liquid as defined in claim 1;

(ii) a second part comprising an oxidation catalyst, the second part being optionally combined with the first part; and (iii) an oxygen source as a third part.

24. A kit of parts for use in a method of removing chewing gum residues from substrates, the kit comprising:

(i) a first part comprising an ionic liquid as defined in claim 1;

(ii) a second part comprising one or more natural or modified enzymes selected from the group consisting of: laccases, peroxidases, lignases and lipoxygenases;

(iii) a third part comprising one or more enzyme mediator compounds, the third part being optionally combined with the first part or the second part.

25. A composition comprising:

(i) an ionic liquid having the formula [Cat].sup.+[X].sup.−, wherein [Cat].sup.+ is a cationic species and [X].sup.− is selected from the group consisting of: [F].sup.−, [Cl].sup.−, [I].sup.−, [NO.sub.3].sup.−, [NO.sub.2].sup.−, [SbF.sub.6].sup.−, [SCN].sup.−, [H.sub.2PO.sub.4].sup.−, [HPO.sub.4].sup.2−, [PO.sub.4].sup.3−, [HSO.sub.4].sup.−, [SO.sub.4].sup.2−, [CH.sub.3SO.sub.3].sup.−, [C.sub.2H.sub.5SO.sub.3].sup.−, [C.sub.8H.sub.17SO.sub.3].sup.−, [CH.sub.3(C.sub.6H.sub.4)SO.sub.3].sup.−, [docusate].sup.−, [C.sub.8H.sub.17OSO.sub.3].sup.−, wherein n is an integer from 1 to 10, [CF.sub.3CO.sub.2].sup.−, [(CF.sub.3SO.sub.2).sub.3C].sup.−, [(CF.sub.3SO.sub.2).sub.2N].sup.−, [CF.sub.3SO.sub.3].sup.−, [(CF.sub.3).sub.2N].sup.−, [(C.sub.2F.sub.5).sub.3PF.sub.3].sup.−, [(C.sub.3F.sub.7).sub.3PF.sub.3].sup.−, [(C.sub.2F.sub.5).sub.2P(O)O].sup.−, [(CH.sub.3).sub.2PO.sub.4].sup.−, [(CH.sub.3).sub.2P(O)O].sup.−, [{(CH.sub.3).sub.3CCH.sub.2CH(CH.sub.3)CH.sub.2}.sub.2P(O)O].sup.−, [HCO.sub.2].sup.−, [CH.sub.3CO.sub.2].sup.−, [CH.sub.3CH.sub.2CO.sub.2].sup.−, [CH.sub.2(OH)CO.sub.2].sup.−, [CH.sub.3CH(OH)CO.sub.2].sup.−, [HCO.sub.3].sup.−, [CO.sub.3].sup.2−, [CH.sub.3OCO.sub.2].sup.−, [C.sub.2H.sub.5OCO.sub.2].sup.−, [saccharin].sup.−, and [linoleate].sup.−;

and (ii) one or more natural or modified enzymes selected from the group consisting of: laccases, peroxidases, lipoxygenases and ligninases and wherein the composition further comprises one or more enzyme mediator compounds selected from the group consisting of:

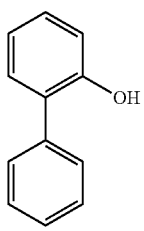

2-hydroxybiphenyl

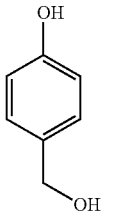

4-hydroxybenzyl alcohol

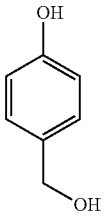

4-methoxybenzyl alcohol

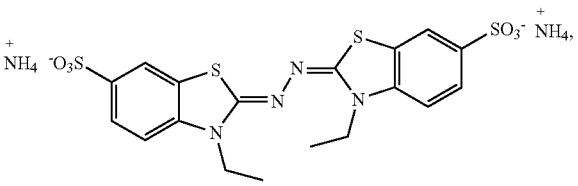

2,2′-azine-bis(3-ethylbenzothiazoline-6-sulfonic acid) (ABTS)

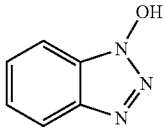

1-hydroxybenzotriazole

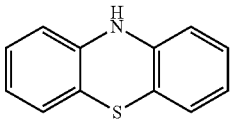

10-H-phenothazine

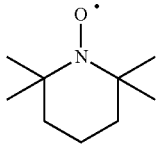

2,2,6,6-tetramethyl-1-piperadinyloxyl (TEMPO)

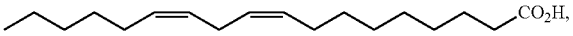

Linoleic acid

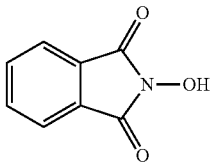

N-hydroxyphthaleimide

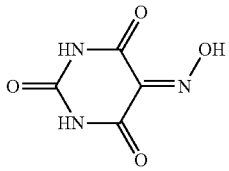

violuric acid and

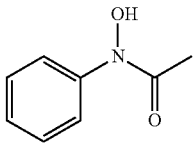

N-hydroxyacetanilide

* * * * *